US010056716B2

(12) United States Patent
Fujita et al.

(10) Patent No.: US 10,056,716 B2
(45) Date of Patent: Aug. 21, 2018

(54) FEMALE CONNECTOR, AND CONNECTION STRUCTURE OF FEMALE CONNECTOR AND MALE CONNECTOR

(71) Applicants: Nintendo Co., Ltd., Kyoto-shi, Kyoto (JP); HOSIDEN CORPORATION, Yao-shi, Osaka (JP)

(72) Inventors: Kumpei Fujita, Kyoto (JP); Hiroki Ikuta, Kyoto (JP); Shinji Hirose, Kyoto (JP); Naoki Yamachika, Yao (JP); Hideaki Taketsu, Yao (JP)

(73) Assignees: Nintendo Co., Ltd., Kyoto-Shi, Kyoto (JP); Hosiden Corporation, Yao-Shi, Osaka (JP)

( * ) Notice: Subject to any disclaimer, the term of this patent is extended or adjusted under 35 U.S.C. 154(b) by 0 days.

(21) Appl. No.: 15/233,185

(22) Filed: Aug. 10, 2016

(65) Prior Publication Data

US 2017/0062979 A1 Mar. 2, 2017

(30) Foreign Application Priority Data

Aug. 28, 2015 (JP) ..... 2015-169554

(51) Int. Cl.
*H01R 13/631* (2006.01)
*H01R 12/70* (2011.01)
(Continued)

(52) U.S. Cl.
CPC ..... *H01R 13/631* (2013.01); *H01R 12/7005* (2013.01); *H01R 13/629* (2013.01);
(Continued)

(58) Field of Classification Search
CPC ..... H01R 12/91; H01R 12/7005
(Continued)

(56) References Cited

U.S. PATENT DOCUMENTS 5,357,402 A * 10/1994 Anhalt ..... G06K 7/0047 174/51
5,427,534 A * 6/1995 Spickler ..... H01R 13/28 439/325
(Continued)

FOREIGN PATENT DOCUMENTS

JP 05-82207 A 4/1993
JP H08185924 A 7/1996
(Continued)

OTHER PUBLICATIONS

Extended European Search Report for Application No. EP 16020314.7, published by the EPO, dated Dec. 2, 2016, including corresponding Communication, Annex, Information on Strategy, and 5-page EPO Form 1703.

*Primary Examiner* — Tulsidas C Patel
*Assistant Examiner* — Marcus Harcum
(74) *Attorney, Agent, or Firm* — Kilyk & Bowersox, P.L.L.C.

(57) ABSTRACT

A female connector including a guide extending in a first direction, a pair of support portions on one side in the first direction relative to the guide, an insulative female body between the support portions, a female terminal held in the female body, and a shaft. The guide guides a mating male connector in the first direction floatably along a second direction orthogonal to the first direction. The support portions are spaced from each other in the second direction and each have a support hole passing therethrough in the second direction. The female body has a through hole passing in the second direction through at least a portion in the second direction of the female body. The shaft is received in the support holes of the support portions and the through hole of the female body so as to support the female body floatably along the second direction.

26 Claims, 15 Drawing Sheets

Exhibit - Annotated

(51) Int. Cl.
*H01R 13/629* (2006.01)
*H01R 13/502* (2006.01)
*H01R 13/627* (2006.01)

(52) U.S. Cl.
CPC ..... *H01R 13/6315* (2013.01); *H01R 13/502* (2013.01); *H01R 13/6278* (2013.01)

(58) Field of Classification Search
USPC ..... 439/248, 247, 374, 64, 660
See application file for complete search history.

(56) References Cited

U.S. PATENT DOCUMENTS 5,483,422 A * 1/1996 Bowen ..... G06K 7/0047 235/486
5,860,828 A * 1/1999 Anderson ..... G06K 19/077 439/377
6,033,253 A * 3/2000 Yi ..... H01R 13/24 439/377
6,206,713 B1 * 3/2001 Baertsoen ..... H01R 12/88 439/260
6,447,317 B1 * 9/2002 Billman ..... H01R 12/88 439/108
6,527,189 B2 * 3/2003 Fan ..... G06K 7/0013 235/483
7,168,622 B2 * 1/2007 Chen ..... H01R 12/721 235/483
2007/0249200 A1 10/2007 Chen et al.
2009/0104810 A1 4/2009 Matsuzawa

FOREIGN PATENT DOCUMENTS

NL 65179 C 9/1949
WO 2011122158 A1 10/2011

* cited by examiner

Exhibit - Annotated

FEMALE CONNECTOR, AND CONNECTION STRUCTURE OF FEMALE CONNECTOR AND MALE CONNECTOR

CROSS-REFERENCE TO RELATED APPLICATION

The present application claims priority under 35 U.S.C. § 119 of Japanese Patent Application No. 2015-169554 filed on Aug. 28, 2015, the disclosure of which is expressly incorporated by reference herein in its entirety.

BACKGROUND OF THE INVENTION

Technical Field

The invention relates to female connectors, and connection structures of female connectors and male connectors.

Background Art

A conventional female connector is disclosed in Japanese Unexamined Patent Publication No. H05-82207. The female connector includes a body, a plurality of terminals held in the body, a plate, a metal part, a pair of springs, and a floating structure. The body is a rectangular insulative plate having a back face, a first side face, and a second side face. The metal part, generally U-shaped in plan view, includes a central plate, a first side plate, and a second side face to respectively cover the back face, the first side face, and the second side face of the body. The springs hold the body in a horizontally movable manner, with one of the springs disposed between the first side face of the body and the first side plate of the metal part, and the other spring disposed between the second side face of the body and the second side plate of the metal part. The plate has a window for detachably receiving a male connector. The floating structure includes a pair of mounting holes elongated horizontally in the body, a pair of bosses on the plate, and a pair of screws. The bosses are received in the holes such as to be movable horizontally. The screws are screwed to the bosses through the metal part and the body. Releasing the screws enables the bosses to move horizontally inside the holes, so that the body is floatable along the horizontal direction relative to the plate.

SUMMARY OF INVENTION

The above conventional connector floating structure requires the pair of mounting holes, the pair of bosses, and the pair of screws, resulting in a large number of components for the floating structure.

The invention is devised in view of the above circumstances and provides a female connector equipped with a floating structure consisting of a reduced number of components. The invention also provides a connection structure of such a female connector and a male connector.

A female connector according to an aspect of the invention is used for mating with a male connector and includes a guide, a pair of support portions, a female body, a female terminal, and a shaft. The guide extends in a first direction and is configured to guide the male connector in the first direction such that the male connector is floatable along a second direction. The second direction is orthogonal to the first direction. The support portions are located on one side in the first direction relative to the guide and spaced from each other in the second direction, and each support portion has a support hole passing therethrough in the second direction. The female body is insulative and disposed between the support portions, and has a through hole passing in the second direction through at least a portion in the second direction of the female body. The female terminal is held in the female body. The shaft is received in the support holes of the support portions and the through hole of the female body so as to support the female body floatably along the second direction.

The female connector of this aspect is equipped with a floating structure in which the female body of the female connector is floatable along the second direction. The floating structure is comprised of the shaft, the support holes of the support portions, and the through hole of the female body. This floating structure of the female connector is advantageously reduced in number of components.

In the female connector according to another aspect of the invention, the shaft may extend through at least a portion in the second direction of the female body in the second direction, and may be fixed to the female body. In this case, the shaft may be fixed to the female body by insert molding or other means, or the shaft may extend in the second direction through the through hole of the female body, and fixed to the through hole of the female body. In the former case, the through hole is omitted. The shaft is preferably received in the support holes of the support portions such as to be floatable along the second direction.

The floating structure of this aspect enabling the female body of the female connector to float along the second direction is comprised of the shaft, the support holes of the support portions, and the female body. This floating structure of the female connector is advantageously reduced in number of components.

The female connector according to still another aspect of the invention does not include a shaft and has the following configuration. The female body includes at least one opposing portion facing the support portions. The opposing portion includes a shaft part extending in the second direction, and the support portions have a support hole receiving the shaft part such that the shaft part is floatable along the second direction. Alternatively, the support portions include a shaft part extending in the second direction, and the opposing portion has a support hole receiving the shaft part such that the shaft part is floatable along the second direction.

The floating structure of this aspect enabling the female body of the female connector to float along the second direction is comprised of the shaft part and the support hole. This floating structure of the female connector is advantageously reduced in number of components.

The guide may include a pair of rails extending in the first direction. In this case, the rails may be configured to guide a runner of the male connector in the first direction, with the runner being received between the rails with a clearance in the second direction. Alternatively, the guide may include at least one rail extending in the first direction. In this case, the rail may be configured to guide the male connector in the first direction, with the rail being received, with a clearance in the second direction, in a runner groove of a runner of the male connector.

The female connector of any aspect above may further include a pair of covers. The covers may extend from the respective support portions such as to cover the female body from one side in a third direction. The third direction may be orthogonal to the first and second directions. The female terminal may include a contact portion exposed to the other side in the third direction out of the female body. The guide may further include a bottom between the rails. The bottom may be located on the other side in the third direction relative to the contact portion of the female terminal.

The floating structure of this aspect reduces the risk that a user of the female connector touches the contact of the female terminal. More particularly, the risk of touching the contact portion from the one side in the third direction is reduced because the female body holding the female terminal is covered with the cover on one side in the third direction, and because the contact portion of the female terminal is exposed out of the female body to the other side in the third direction. It is also difficult for a user of the female connector to touch the contact portion of the female terminal from the other side in the third direction because the contact portion of the female terminal is exposed out of the female body to the other side in the third direction but the bottom of the guide is located on the other side in the third direction relative to the contact portion of the female terminal.

The guide may include a pair of first abutment portions. The female connector may further include a female biasing portion. The female biasing portion may be provided at the guide such as to bias the male connector to one side in the third direction to bring the male connector into abutment with the first abutment portions.

The floating structure of this aspect minimizes backlash in the third direction between the female connector and the male connector guided the guide of the female connector. This is because the female body and the male connector are held in the third direction by and between the first abutment portions and the female biasing portion.

The female connector of any aspect above may further include a pair of second biasing portions and a female biasing portion. The second abutment portions may extend from the respective support portions and abut the female body from one side in the third direction. The female biasing portion may be provided at the guide such as to bias the male connector to the one side in the third direction to bring a male terminal of the male connector into elastic contact with the female terminal. The second biasing portions may function as the covers.

The floating structure of this aspect minimizes backlash in the third direction between the male connector and the female connector when the male terminal of the male connector is in contact with the female terminal of the female connector. This is because the female body and the male connector are held in the third direction by and between the second biasing portions and the female biasing portion.

The guide may further include a bottom between the rails. The bottom may include an end portion on the one side in the first direction. The end portion may have an opening passing through the bottom in the third direction.

The floating structure of this aspect is suitably configured for readily removing unwanted materials (e.g. dust, lint, dirt, etc.) accumulated on the bottom of the guide. Particularly, when the runner of the male connector is guided in the first direction by the rail, the runner pushes unwanted materials on the bottom outwardly and eject them through the opening in the bottom of the guide.

A connection structure of an aspect of the invention includes the female connector of any aspect above and a male connector. The male connector includes a runner, a male body, and a male terminal. The runner may be configured to be guided in the first direction by the guide of the female connector such that the runner is floatable along the second direction. The male terminal may be held in the male body and contactable with the female terminal of the female connector.

The guide of the female connector may further include a female engagement portion. The male connector may further include a male engagement portion.

The female engagement portion may be an engagement hole extending in the second direction. The male body may include an accommodation portion configured to accommodate the male engagement portion such that the male engagement portion is movable in the second direction. The male connector may further include a male biasing portion. The male biasing portion may be configured to exert an biasing force on the male engagement portion to one side in the second direction. The guide of the female connector may be configured such that, while guiding the runner of the male connector, the guide presses and moves the male engagement portion to the other side in the second direction against the biasing force of the male biasing portion. The male engagement portion may be configured such that, when the male terminal is brought into contact with the female terminal and the accommodation portion is brought into communication with the female engagement portion, the male engagement portion is moved to the one side in the second direction by the biasing force of the male biasing portion and engages with the female engagement portion.

In the connection structure of this aspect, when connecting the male connector to the female connector, the male engagement portion is biased by the male biasing portion and automatically brought into engagement with the female engagement portion.

If the female engagement portion is an engagement hole, the male engagement portion may be an engagement protrusion to engage with the engagement hole when the male terminal contacts the female terminal. Alternatively, the male engagement portion may be an engagement hole, and the female engagement portion may be an engagement protrusion to engage with the engagement hole when the male terminal contacts the female terminal.

BRIEF DESCRIPTION OF DRAWINGS

The present invention can be even more fully understood with the reference to the accompanying drawings which are intended to illustrate, not limit, the present invention.

Figure 1A:
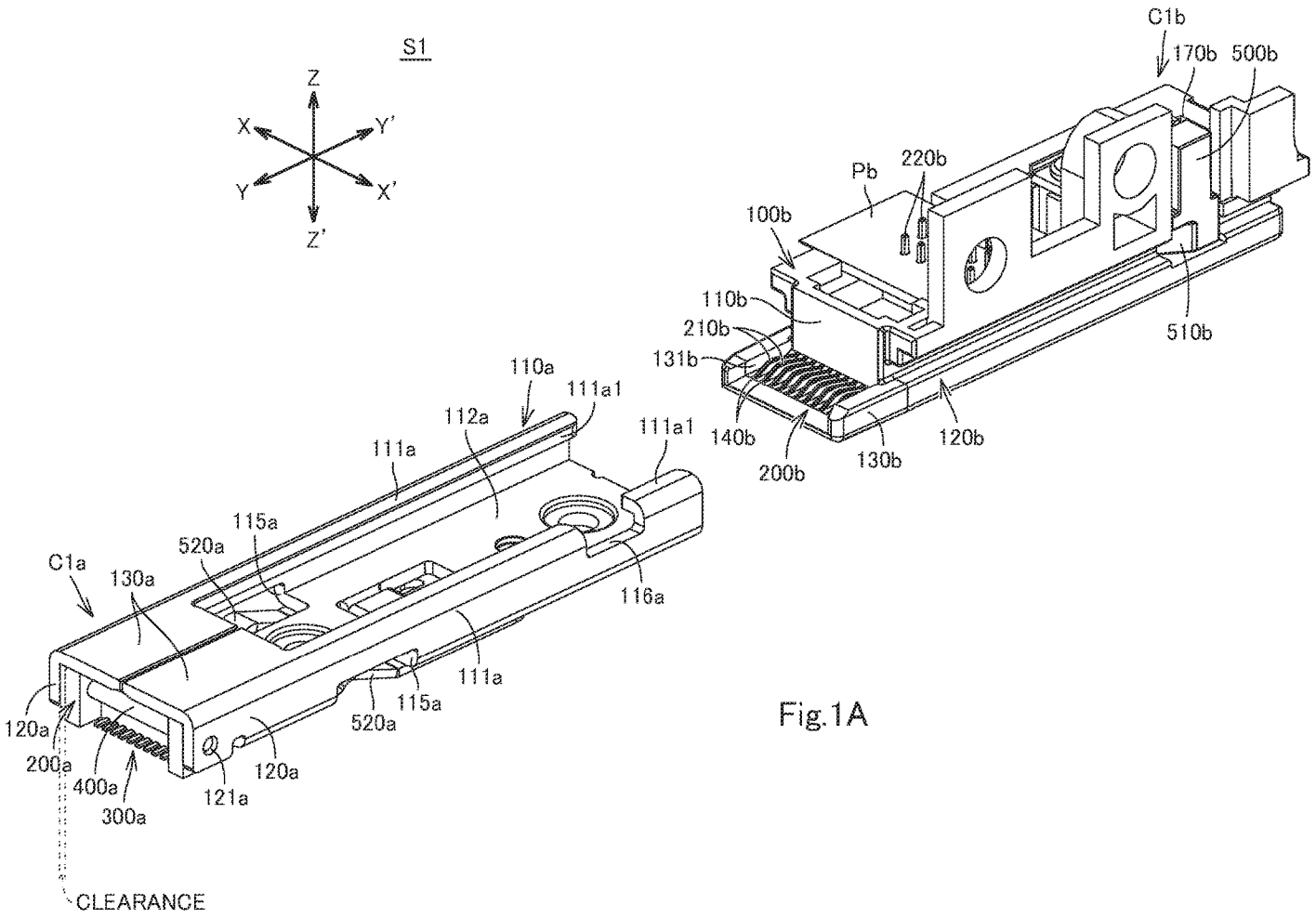
FIG. 1A is a front, top, right side perspective view of a connection structure of the first embodiment of the invention, in which the male connector is yet to be connected to the female connector.

In the brief description of the drawings above and the description of embodiments which follows, relative spatial terms such as "upper", "lower", "top", "bottom", "left", "right", "front", "rear", etc., are used for the convenience of the skilled reader and refer to the orientation of the female connectors, and the connection structures of female connectors and male connectors, and their constituent parts as depicted in the drawings. No limitation is intended by use of these terms, either in use of the invention, during its manufacture, shipment, custody, or sale, or during assembly of its constituent parts or when incorporated into or combined with other apparatus.

DESCRIPTION OF EMBODIMENTS

Figure 1B:
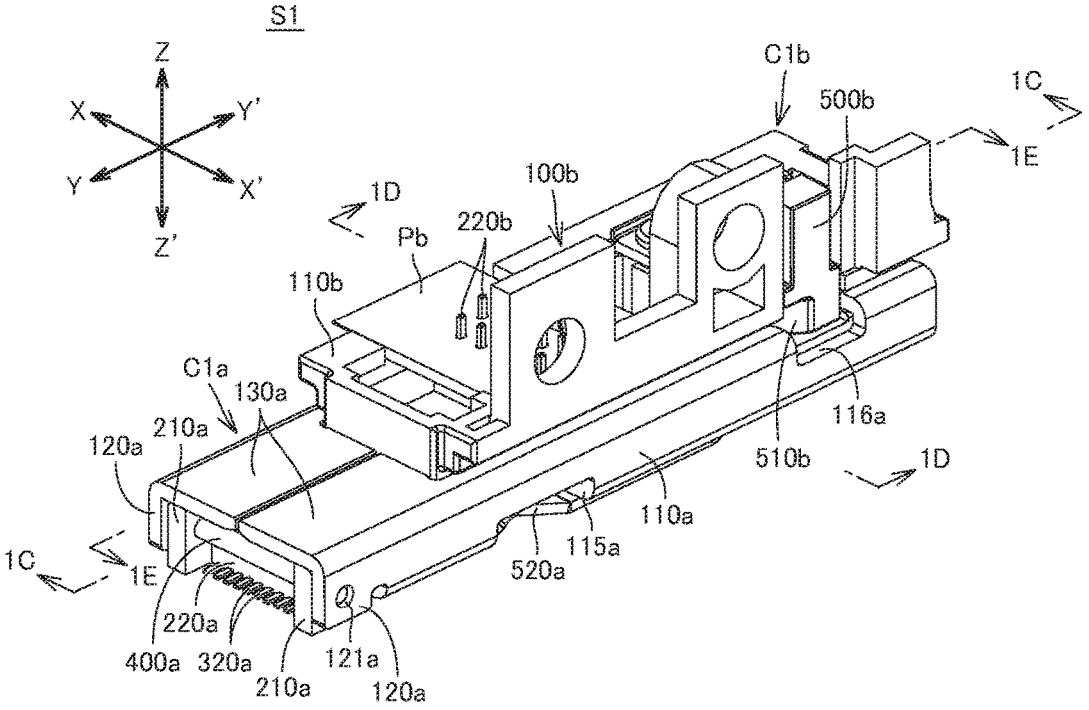
FIG. 1B is a front, top, right side perspective view of the connection structure, in which the male connector is connected to the female connector.
Figure 1C:
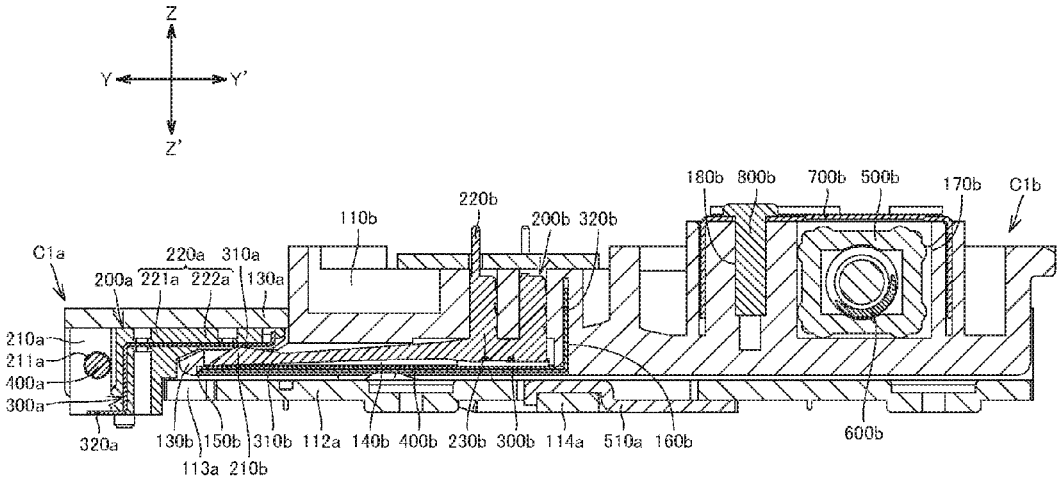
FIG. 1C is a sectional view of the connection structure, taken along 1C-1C in FIG. 1B.
Figure 1D:
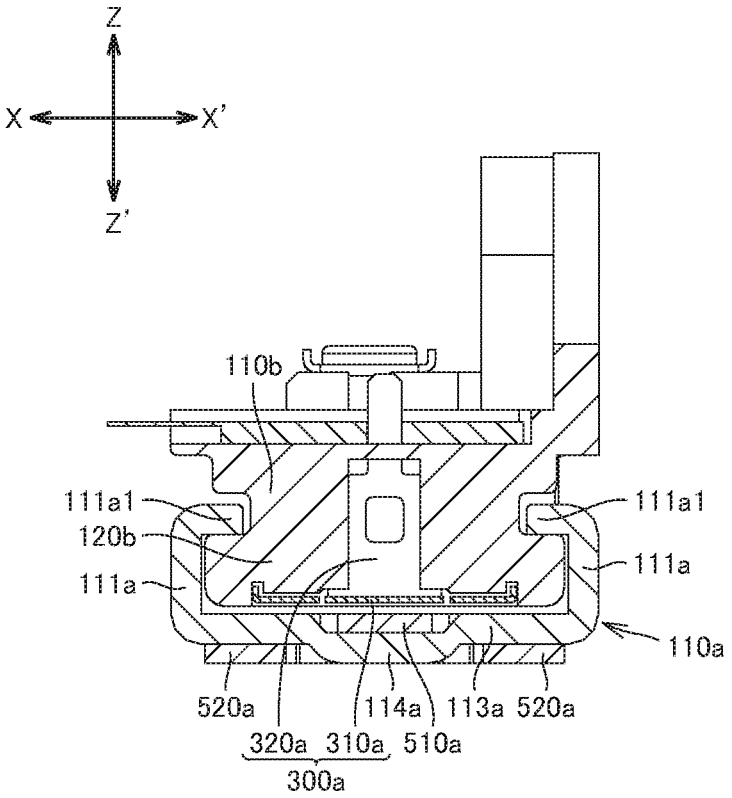
FIG. 1D is a sectional view of the connection structure, taken along 1D-1D in FIG. 1B.
Figure 1E:
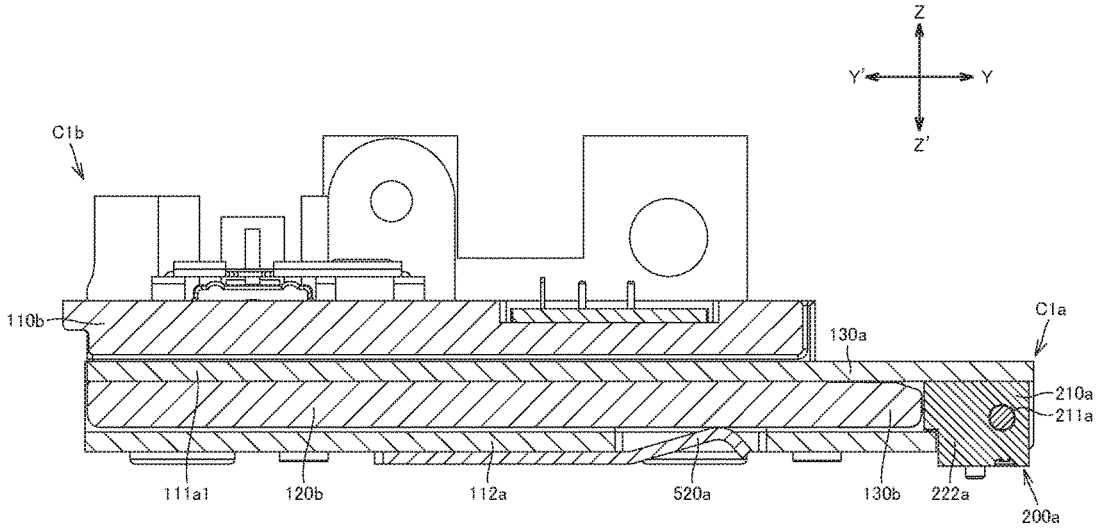
FIG. 1E is a sectional view of the connection structure, taken along 1E-1E in FIG. 1B.
Figure 2A:
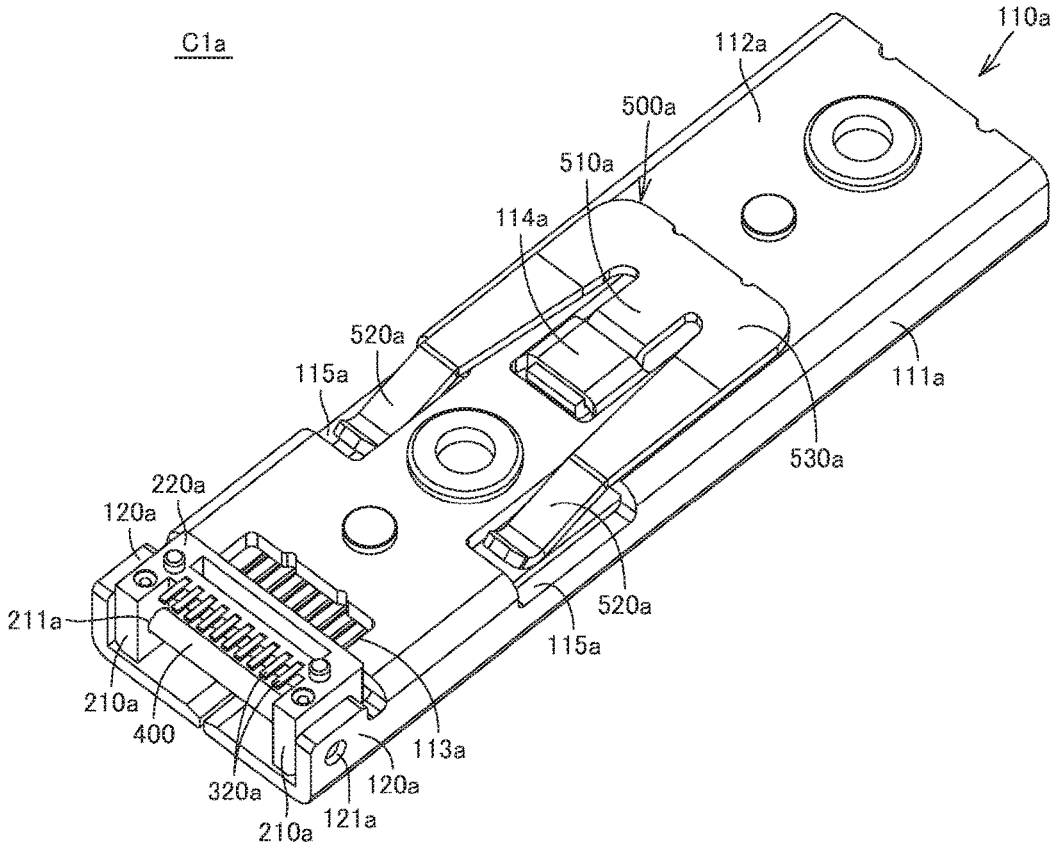
FIG. 2A is a front, bottom, left side perspective view of the female connector.
Figure 2B:
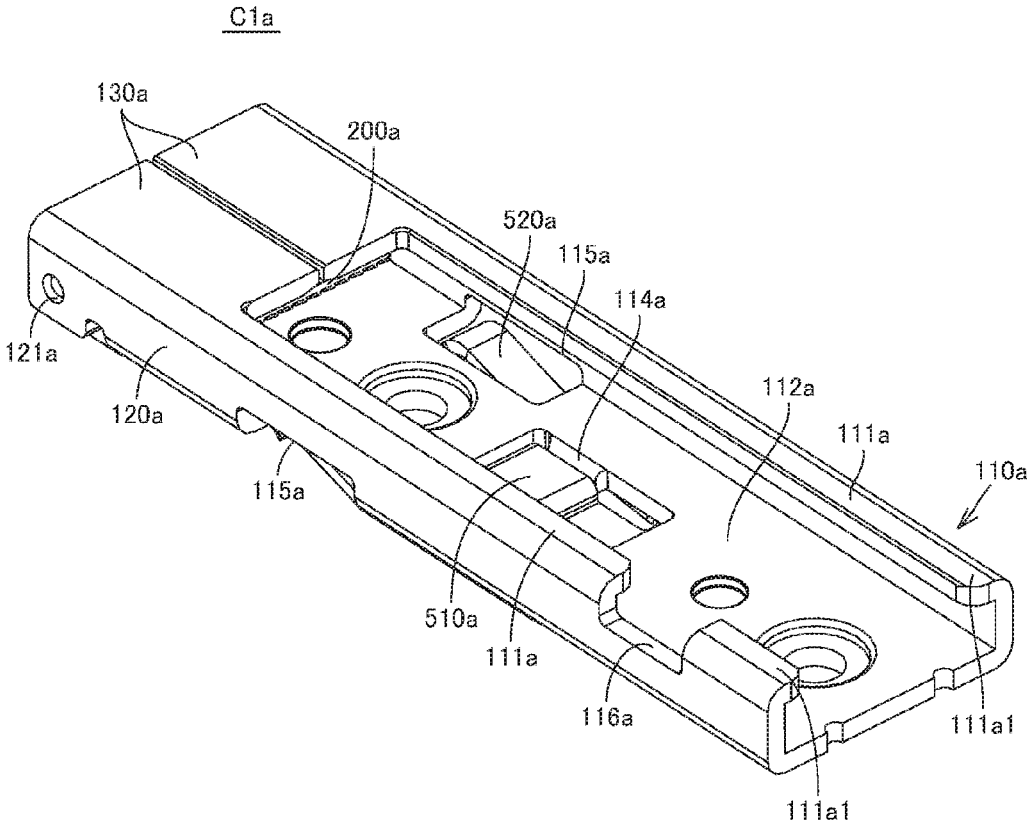
FIG. 2B is a rear, top, right side perspective view of the female connector.
Figure 2C:
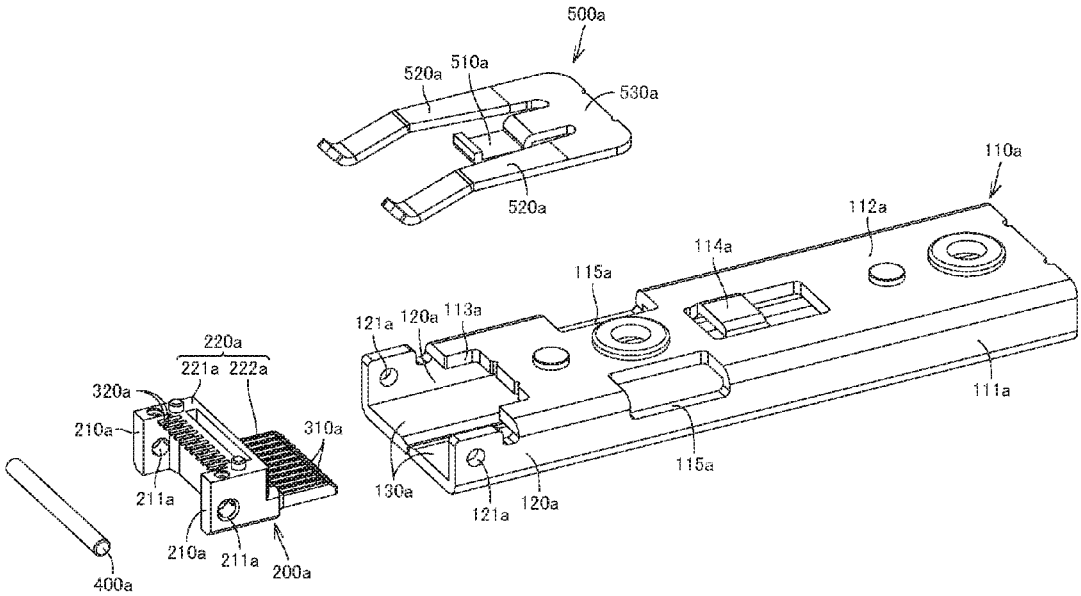
FIG. 2C is a front, bottom, left side perspective and exploded view of the female connector.
Figure 2D:
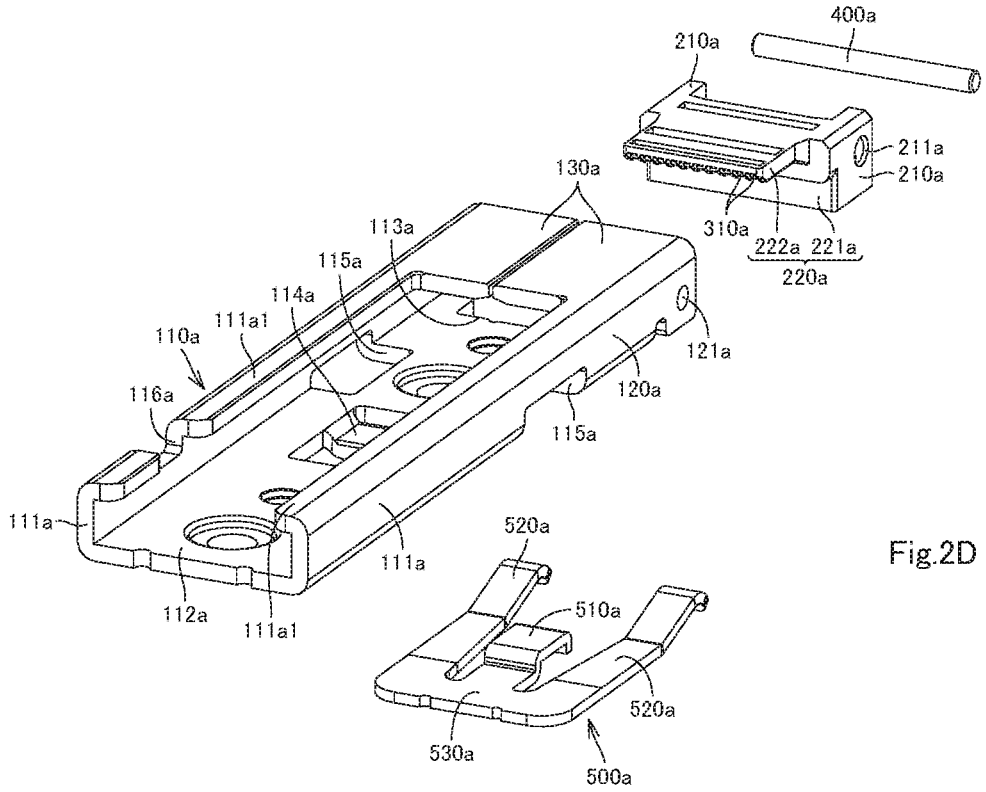
FIG. 2D is a back, top, left side perspective and exploded view of the female connector.
Figure 3A:
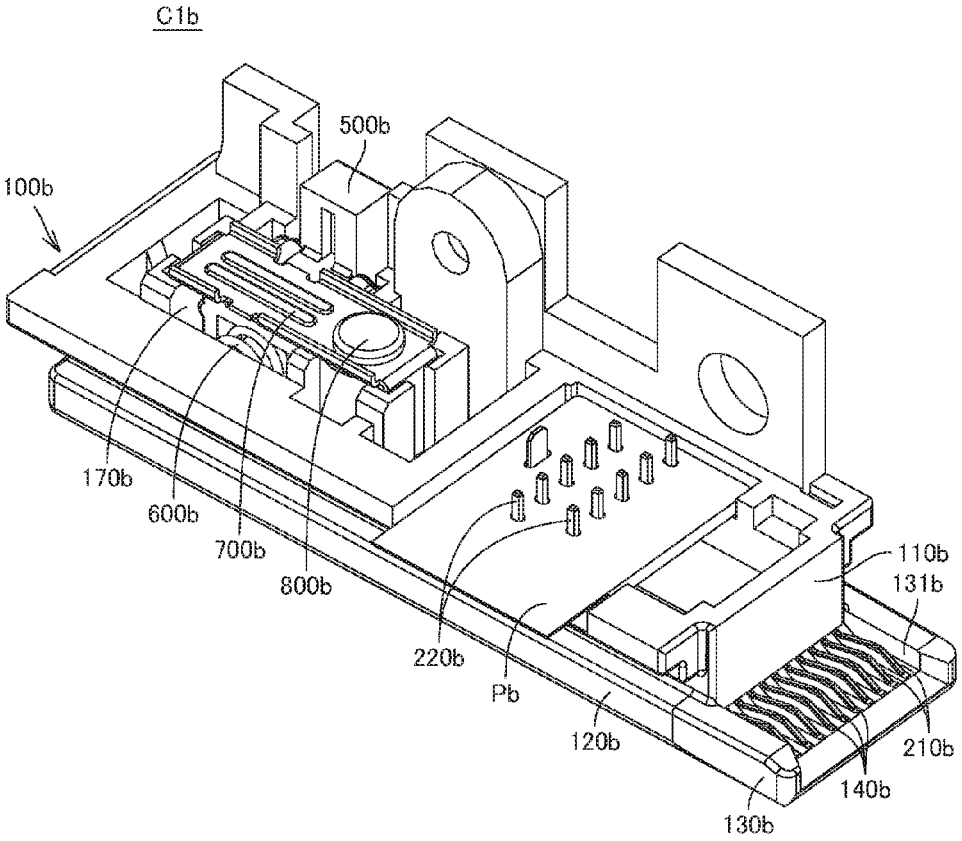
FIG. 3A is a front, top, left side perspective view of the male connector.
Figure 3B:
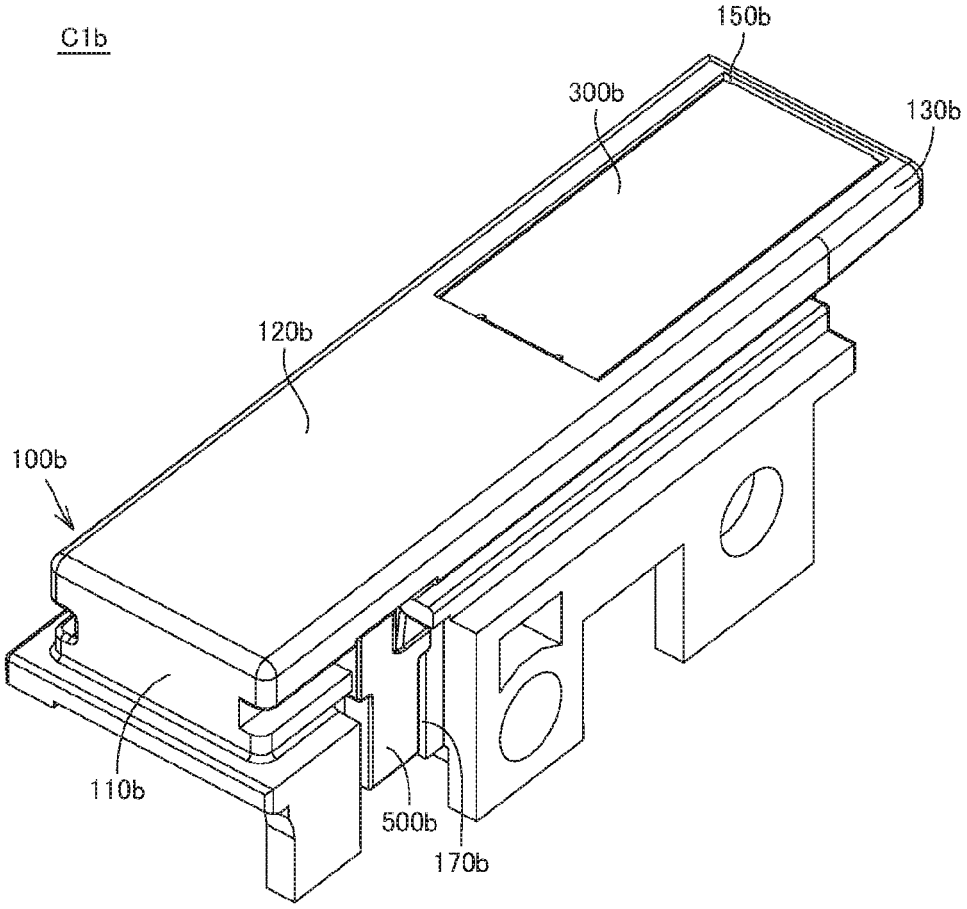
FIG. 3B is a rear, bottom, right side perspective view of the male connector.
Figure 3C:
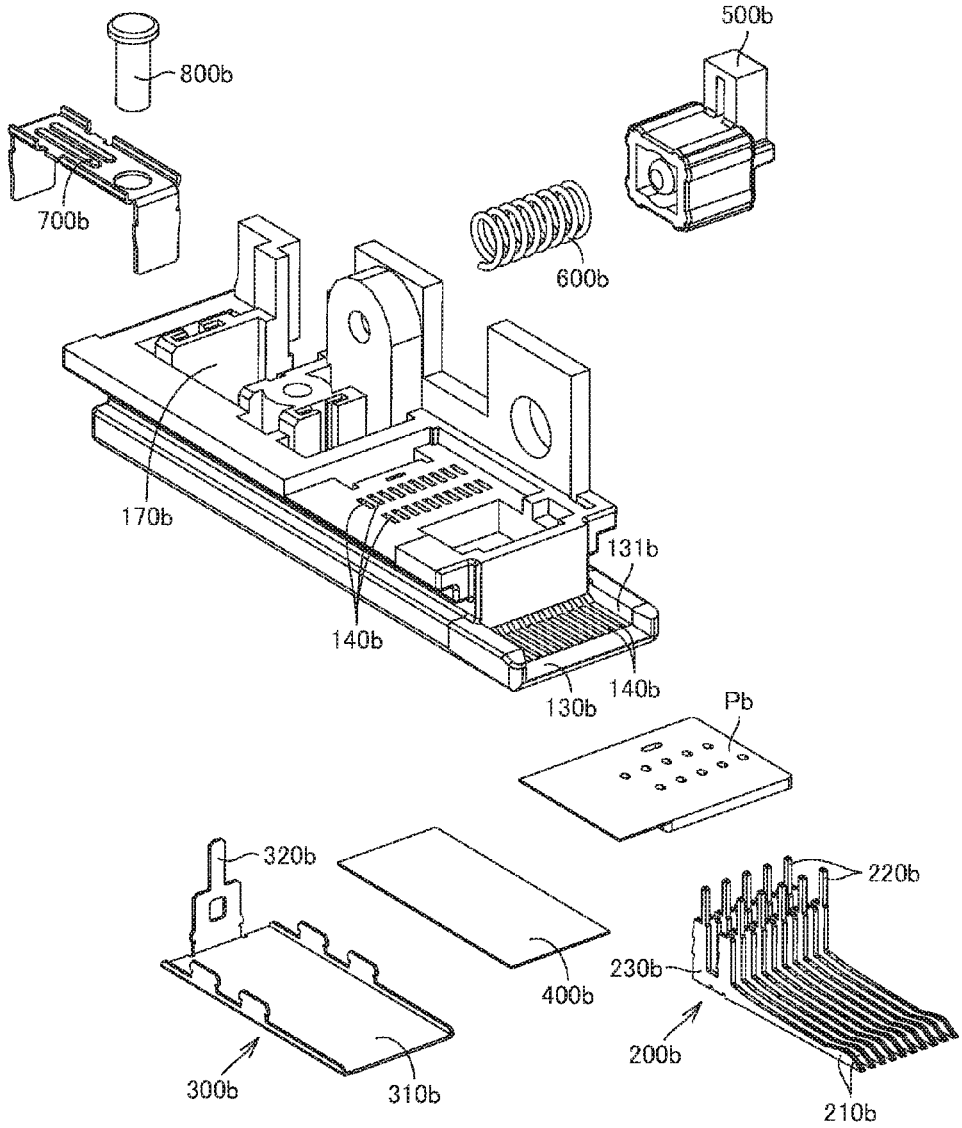
FIG. 3C is a front, top, left side perspective and exploded view of the male connector.
Figure 3D:
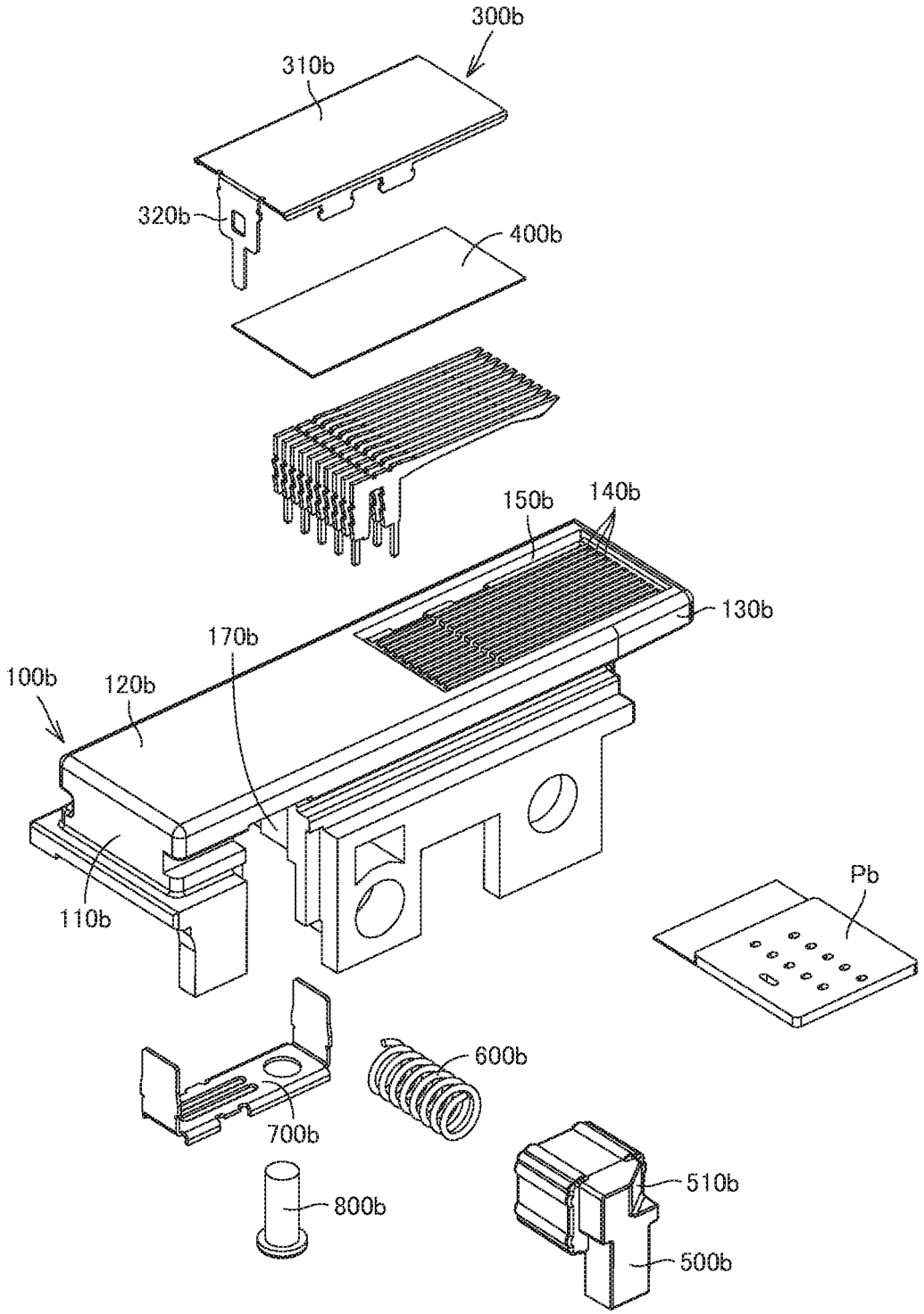
FIG. 3D is a back, bottom, right side perspective and exploded view of the male connector.

A connection structure S1 according to some embodiments of the invention includes a female connector C1*a* and a male connector C1*b*. FIGS. 1 to 3D shows an embodiment (hereinafter referred to as the first embodiment) of the connection structure S1. The female connector C1*a* will be described referring to FIGS. 1A to FIG. 2D, and the male connector C1*b* will be described referring to FIGS. 1A to 1E and FIGS. 3A to 3D. It should be appreciated that FIGS. 1A to 1C and FIG. 1E indicate the Y-Y' direction, in which the male connector C1*b* is guided by a guide 110*a* (to be described) of the female connector C1*a*. The Y-Y' direction corresponds to the "first direction" set forth in the claims. FIGS. 1A, 1B, and 1D indicates the X-X' direction, which corresponds to the "second direction" in the claims. The X-X' direction is orthogonal to the Y-Y' direction. FIGS. 1A to 1E indicates the Z-Z' direction, which is the height direction of the female connector C1*a* and the male connector C1*b* and corresponds to the "third direction" set forth in the claims. The Z-Z' direction is orthogonal to the Y-Y' and X-X' directions.

The male connector C1*b* may preferably include a body 100*b* (hereinafter referred to as a male body 100*b*), a runner 120*b*, and a plurality of terminals 200*b* (hereinafter referred to as male terminals 200*b*).

The male body 100*b* is made of an insulating resin. The male body 100*b* may include a male main body 110*b*. The male main body 110*b* is a block, i.e. a solid piece of insulating resin.

The runner 120*b* may be of any configuration as long as it can be guided movably in the Y-Y' direction by the guide 110*a* (to be described) of the female connector C1*a* such as to be floatable along the X-X' direction. For example, the runner 120*b* may be a plate extending in the Y-Y' and X-X' directions, an elongate projection extending in the Y-Y' direction, a plurality of elongate projections extending in the Y-Y' direction and being arranged in spaced relation in the X-X' direction, a row of projections spaced in the Y-Y' direction, or a plurality of rows of projections spaced in the Y-Y' direction. The rows may preferably be spaced in the X-X' direction. The runner 120*b* may be integral with any suitable part of the male main body 110*b*, or may be formed separately from the male main body 110*b* and fixed to any suitable part of the male main body 110*b*.

In FIGS. 1A to 1E and FIGS. 3A to 3D, the runner 120*b* is a rectangular plate extending in the X-X' and Y-Y' directions to be integral with the Z'-direction end of the male main body 110*b*. The runner 120*b* is larger in the X-X' direction than the Z'-direction end of the male main body 110*b*.

The female connector C1*a* may include the guide 110*a*, a pair of support portions 120*a*, a female body 200*a*, a plurality of female terminals 300*a*, and a shaft 400*a*.

The guide 110*a* extends in the Y-Y' direction. The guide 110*a* may preferably be configured to guide the runner 120*b* of the male connector C1*b* in the Y-Y' direction between an initial position and a connection position such that the runner 120*b* is floatable along the X-X' direction. Here the initial position is the position at which the guide 110*a* starts to guide the runner 120*b*. The connection position is the position at which the male connector C1*b* is connected to the female connector C1*a*, i.e. the position at which the male terminals 200*b* (to be described) of the male connector C1*b* are in contact with the associated female terminals 300*a* of the female connector C1*a*.

The guide 110*a* may take a variety of forms, such as at least one frame extending in the Y-Y' direction, or at least one rail groove extending in the Y-Y' direction. The guide 110*a*, i.e. the or each frame or the or each rail groove, may include a pair of rails 111*a*. The rails 111*a* of the at least one frame are plates extending in the Y-Y' direction and are spaced from each other in the X-X' direction. The rails 111*a* of the at least one rail groove are walls on the X- and X'-direction sides of the rail groove, extend in the Y-Y' direction, and are spaced from each other in the X-X' direction. In either case, the rails 111*a* may be configured to guide the runner 120*b* (i.e., the plate, one or more elongate projections, or one or more rows of projections) in the Y-Y' direction such that the runner 120*b* is floatable along the X-X' direction. Accordingly, the runner 120*b* is receivable in between the rails 111*a* with a clearance in the X-X' direction. More specifically, the X-X' direction distance between the rails 111*a* may preferably be slightly larger than the X-X' direction dimension of the runner 120*b*. FIGS. 1A to FIG. 2D illustrates the guide 110*a* as having a frame, which has a pair of rails 111*a* extend in the Z-Z' direction and then closer to each other to each form a generally L-shape. The guide 110*a* may include more than one frame or more than one rail groove.

Depending on the specific configuration of the runner 120*b*, the X-X' direction dimension of the runner 120*b* may specifically be: a) the X-X' direction dimension of the plate; b) the X-X' direction dimension of the elongate projection; c) the X-X' direction dimension of the row of projections; d) the X-X' direction distance between the outer end faces of the outermost ones of the elongate projections arranged in the X-X' direction; or e) the X-X' direction distance between the outer end faces of the projections in the outermost rows out of the plurality of rows arranged in the X-X' direction.

The support portions 120*a* are provided on the Y-direction side (one side in the first direction) of the guide 110*a* and are spaced from each other in the X-X' direction. For example, the support portions 120*a* may extend in the Y direction from the respective Y-direction ends of the rails 111*a* of the guide 110*a* as at least one frame, as shown in FIG. 1A to FIG. 2D. Or alternatively, the support portions 120*a* may extend in the Y direction from the respective Y-direction ends of the rails 111*a* of the guide 110*a* as at least one rail groove. The support portions 120*a* each have a support hole 121*a* passing therethrough in the X-X' direction. The support holes 121*a* have a Z-Z' direction height that may preferably be determined in accordance with the Z-Z' direction height of the male connection portion 130*b* (to be described) or the male connection hole (to be described) of the male connector C1*b*.

The female body 200*a* is formed of an insulating resin. The female body 200*a* has an X-X' direction dimension that is smaller than the X-X' direction distance between the support portions 120*a*. The female body 200*a* is disposed between the support portions 120*a*. The female body 200*a* may have at least one through hole 211*a*. The through hole 211*a* may preferably pass in the X-X' direction through at least a portion in the X-X' direction of the female body 200*a*. In other words, the through hole 211*a* may pass in the X-X' direction through the entire width in the X-X' direction of the female body 200*a*. The female body 200*a* may include at least one wing 210*a* and a female main body 220*a*. The at least one wing 210*a* may preferably extend from the female main body 220*a* in a direction containing a Y'-, Y-, Z-, or Z'-direction component. The or each through hole 211*a* preferably passes in the X-X' direction through the associated wing 210*a*. The embodiment of FIG. 1A to FIG. 2D includes a pair of wings 210*a* extending in the Y direction from the X- and X'-direction ends, respectively, of the Y-direction end face of the female main body 220*a*. The wings 210*a* each have a through hole 211*a* passing therethrough in the X-X' direction.

The shaft 400*a* is a metal or plastic rod of a circular cylindrical or polygonal columnar shape extending in the X-X' direction. The shaft 400*a* may be received in the support holes 121*a* of the pair of support portions 120*a* and the at least one through hole 211*a* of the female body 200*a* such as to support the female body 200*a* floatably, i.e. movably, in the X-X' direction. To this end, the shaft 400*a* may have an outer diameter corresponding to the diameter of the or each support hole 121*a*, or the shaft 400*a* may have an outer size corresponding to the size of the or each support hole 121*a*. In other words, the shaft 400*a* fits in the support holes 121*a*. Also, the outer diameter of the shaft 400*a* is slightly smaller than the diameter of the or each through hole 211*a* of the female body 200*a*, or the outer size of the shaft 400*a* is slightly smaller than the size of the or each through hole 211*a* of the female body 200*a*. The female body 200*a* is thus floatable along the X-X' direction relative to the shaft 400*a*. In this case, the floating structure of the female connector C1*a* is comprised of the support holes 121*a* of the support portions 120*a*, the through hole or holes 211*a* of the female body 200*a*, and the shaft 400*a*.

Alternatively, the shaft 400*a* may be fixed to the female body 200*a* such as to extend through at least a portion of the female body 200*a*, and received in the support holes 121*a* of the pair of support portions 120*a* such as to be floatable, i.e. movable, along the X-X' direction. Specifically, the shaft 400*a* may be insert-molded in at least the portion of the female body 200*a* (for example, the wings 210*a*), or, as shown in FIG. 1A to FIG. 2D, may be fixed to the through hole 211*a* such as to extend through the through hole or holes 211*a* of the female body 200*a*. The outer diameter of the shaft 400*a* is slightly smaller than the diameter of each support hole 121*a*, or the outer size of the shaft 400*a* is slightly smaller than the size of each support hole 121*a*. The shaft 400*a* is thus received and supported in the support holes 121*a* such as to be floatable along the X-X' direction. In other words, the female body 200*a* and the shaft 400*a* are supported in the support holes 121*a* of the support portions 120*a* such as to be floatable along the X-X' direction. In this case, the floating structure of the female connector C1*a* is comprised of the support holes 121*a* of the support portions 120*a*, the female body 200*a*, and the shaft 400*a*. If the shaft 400*a* is insert-molded in at least the portion of the female body 200*a*, the through hole 211*a* is omitted.

For example, the female main body 220*a* of the female body 200*a* may be a block (i.e. a solid piece of insulating resin) of a rectangular, generally L-shaped, or generally T-shaped cross-section in Y-Y' direction. In the embodiment of FIG. 1A to FIG. 2D where the female main body 220*a* is a block of generally L-shape in Y-Y' direction cross-section, the female main body 220*a* includes a base 221*a* and a tongue 222*a*, and the tongue 222*a* extends in the Y' direction from the Z-direction end of the Y'-direction end face of the base 221*a*. In an embodiment where the female main body 220*a* is a block of generally T-shape in Y-Y' direction cross-section, the female main body 220*a* may include a base 221*a* and a tongue 222*a*, and the tongue 222*a* may extend in the Y' direction centrally from the Y'-direction end face of the base 221*a*.

The female main body 220*a* may preferably have one of the following configurations (1) to (3), but not limited thereto, so that the female connector C1*a* is connectable to the male connector C1*b*.

(1) The Y'-direction end portion of the rectangular female main body 220*a* or the tongue 222*a* of the T- or L-shaped female main body 220*a* may serve as a connection portion (hereinafter referred to as a female connection portion) of the female connector C1*a*. The female connection portion may preferably be receivable in a connection hole (hereinafter referred to as a male connection hole) of the male connector C1*b* as located in the connection position.

(2) The Y'-direction end portion of the rectangular female main body 220*a* or the tongue 222*a* of the T- or L-shaped female main body 220*a* may serve as a female connection portion of the female connector C1*a*, and the female connection portion may have a space on the Z- and/or Z'-direction side to serve as connection hole (hereinafter referred to as a female connection hole). The female connection hole may preferably be defined by at least the female connection portion and the pair of support portions 120*a*. In this case, the female connection portion may preferably be receivable in the male connection hole of the male connector C1*b* as located in the connection position, and the female connection hole may preferably be configured to receive the male connection portion 130*b* (to be described) of the male connector C1*b*.

(3) The Y'-direction end portion of the rectangular female main body 220*a* or the tongue 222*a* of the T- or L-shaped female main body 220*a* may have a female connection hole (not shown) opening in the Y'-direction. The female connection hole may preferably be configured to receive the male connection portion 130*b* of the male connector C1*b* as located in the connection position.

In the embodiment of FIG. 1A to FIG. 2D, the female connector C1*a* includes a tongue 222*a*, which serves as the female connection portion and has a space on the Z'-direction side to serve as the female connection hole.

The female body 200*a* holds the female terminals 300*a* in spaced relation in the X-X' direction such that the female terminals 300*a* are contactable with male terminals 200*b* (to be described) of the male connector C1*b* as located in the connection position. More particularly, the female body 200*a* may have a plurality of holding grooves (not shown) spaced from each other in the X-X' direction. In this case, the female terminals 300*a* are securely press-fitted in the respective holding grooves of the female body 200*a*. Alternatively, the female terminals 300*a* may be insert-molded inside the female body 200*a* in spaced relation in the X-X' direction, as in the embodiment of FIG. 1A to FIG. 2D.

The female terminals 300*a* may be metal plates generally of L-shape or any shape extending in a direction containing a Y-Y' direction component. The female terminals 300*a* each include a contact portion 310*a* and a tail 320*a*. The contact portions 310*a* of the female terminals 300*a* are exposed or protrude out of the female body 200*a* such as to be contactable with associated contact portions 210*b* of the male terminals 200*b* as located in the connection position. More particularly, (1) if the female connector C1*a* includes the female connection portion, the contact portions 310*a* may preferably be exposed or protrude out of the face on the Z- or Z'-direction side of the female connection portion. (2) If the female connector C1*a* includes the female connection portion and the female connection hole, the contact portions 310*a* may preferably be exposed or protrude out of the Z-direction face of the female connection portion such as to be disposed inside the female connection hole on the Z-direction side of the female connection portion, or the contact portions 310*a* are exposed or protrude out of the Z'-direction face of the female connection portion such as to be disposed inside the female connection hole on the Z'-direction side of the female connection portion. (3) If the female connector C1*a* includes the female connection hole, the contact portions 310*a* may preferably be disposed inside the female connection hole. In the embodiment of FIG. 1A to FIG. 2D, the contact portions 310*a* are exposed out of the Z'-direction face of the tongue 222*a* of the female main body 220*a* and disposed inside the female connection hole on the Z'-direction side of the tongue 222*a*.

The tail 320*a* of the female terminal 300*a* may preferably be exposed or protrude out of the female body 200*a* such as to be connectable to an external member not shown, e.g. a circuit board, terminals, a cable, etc. Particularly, the tails 320*a* may protrude in the Y direction out of the Y-direction end face of the female main body 220*a* of the female body 200*a*. Alternatively, the tails 320*a* may protrude in the Z' direction out of the Z'-direction end face of the female main body 220*a*. The embodiment of FIG. 1A to FIG. 2D corresponds to the former configuration, and the tails 320*a* are connectable to a circuit board (not shown, hereinafter referred to as a female circuit board).

The male connector C1*b* may further include one of the following structure (1) to (3) for connection with the female connector C1*a* but not limited thereto. (1) There is provided a connection portion 130*b* (hereinafter referred to as a male connection portion 130*b*) which is detachably connectable to the female connection hole of the female connector C1*a*. More particularly, the male connection portion 130*b* may be provided in the Y-direction end of the runner 120 and extend in the Y direction beyond the male main body 110*b*, or may be provided in the Y-direction end of the male main body 110*b* and extend in the Y direction beyond the runner 120*b*. (2) There are provided a male connection portion 130*b*, which is configured as described above, and a male connection hole (hereinafter referred to as a male connection hole), which may preferably be provided on the Z- or Z'-direction side of the male connection portion 130*b*. (3) There is provided a male connection hole. This male connection hole is provided in the Y-direction end face of the runner 120*b* or of the male main body 110*b* and opens in the Y-direction. In the embodiment of FIGS. 1A to 1E and FIGS. 3A to 3D, there is provided a male connection portion 130*b* and a male connection hole. The male connection portion 130*b* extends in the Y direction from the Y-direction end of the runner 120*b*. The male connection hole is provided as a recess 131*b* in the Z-direction end of the male connection portion 130*b* and opens in the Z direction.

The male body 100*b* holds the plurality of male terminals 200*b* in spaced relation in the X-X' direction. Particularly, the male terminals 200*b* may be insert-molded inside the male body 100*b* in spaced relation in the X-X' direction. Alternatively, the male body 100*b* may have a plurality of holding grooves 140*b* spaced from each other in the X-X' direction. In this case, the male terminals 200*b* are securely press-fitted in the respective holding grooves 140*b* of the male body 100*b*.

The holding grooves 140*b* may have one of the following configurations (1) to (3) but not limited thereto.

(1) If the male connector C1*b* includes the holding grooves 140*b* and the male connection portion 130*b*, the holding grooves 140*b* may preferably have portions located in the male connection portion 130*b* and open in a direction containing a Z- or Z'- direction component.

(2) If the male connector C1*b* includes the holding grooves 140*b*, the male connection portion 130*b*, and the male connection hole, the holding grooves 140*b* may preferably have portions located in the male connection portion 130*b* and in communication with the male connection hole.

(3) If the male connector C1*b* includes the holding grooves 140*b* and the male connection hole, the holding grooves 140*b* may preferably communicate with the male connection hole.

In the embodiment of FIGS. 1A to 1E and FIGS. 3A to 3D, the holding grooves 140*b* extend in the male main body 110*b* and the runner 120*b*, in spaced relation in the X-X' direction, and the holding grooves 140*b* have portions located in the bottom of the recess 131*b* (i.e. the male connection hole) of the male connection portion 130*b* such as to open in the Z direction and communicate with the recess 131*b*.

The male terminals 200*b* may be metal plates. The male terminals 200*b* each include the contact portion 210*b* mentioned above and a tail 220*b*. The contact portion 210*b* is a portion of the male terminal 200*b* and may have one of the following configurations (1) to (3) but not limited thereto.

(1) If the male connector C1*b* includes the male connection portion 130*b*, (1-1) the contact portions 210*b* may be exposed or protrude, in a direction containing a Z- or Z'-direction component, out of the male connection portion 130*b*; or alternatively (1-2) the contact portions 210*b* may be exposed or protrude, in a direction containing a Z- or Z'-direction component, out of portions of the holding grooves 140*b* of the male connection portion 130*b*.

(2) If the male connector C1*b* includes the male connection portion 130*b* and the male connection hole, (2-1) the contact portions 210*b* may be exposed or protrude, in a direction containing a Z-direction component, out of the male connection portion 130*b* such as to be located inside the male connection hole; or alternatively (2-2) the contact portions 210*b* may be exposed or protrude, in a direction containing a Z'-direction component, out of the male connection portion 130*b* such as to be located inside the male connection hole; or alternatively (2-3) the contact portions 210*b* may be exposed or protrude, in a direction containing a Z-direction component, out of portions of the holding grooves 140*b* of the male connection portion 130*b* such as to be located inside the male connection hole; or alternatively (2-4) the contact portions 210*b* may be exposed or protrude, in a direction containing a Z'-direction component, out of portions of the holding grooves 140*b* of the male connection portion 130*b* such as to be located inside the male connection hole.

(3) If the male connector C1*b* includes the male connection hole, the contact portions 210*b* may preferably be located inside the male connection hole.

Each tail 220*b* is another portion (a different portion from the contact portion 210*b*) of each male terminal 200*b*. The tails 220*b* may preferably protrude out of the male body 100*b* such as to be connectable to a circuit board Pb (hereinafter referred to as a male circuit board Pb) or an external member not shown, e.g. terminals or a cable. The male terminals 200*b* may each further include a base 230*b*. Each contact portion 210*b* and each tail 220*b* may preferably extend in different directions from each base 230*b*. For example, the contact portions 210*b* may extend in a direction containing a Y-direction component, while the tails 220*b* may extend in a direction containing a Y'-direction component. Alternatively, the contact portions 210*b* may extend in a direction containing a Y-direction component, while the tails 220*b* may extend in a direction containing a Z-or Z'-direction component.

In the embodiment of FIGS. 1A to 1E and FIGS. 3A to 3D, the male terminals 200*b* each include a contact portion 210*b*, a tail 220*b*, and a base 230*b*. Each contact portions 210*b* extends in the Y direction from the Z'-direction end of the base 230*b*. Each base 230*b* is generally of U-shape with its two legs (first and second legs) extending in the Z-direction. Each tail 220*b* extends in the Z direction from the end of the first or second leg of the associated base 230*b*.

If the male body 100*b* includes the holding grooves 140*b*, the male body 100*b* may further include an open portion 150*b*. The open portion 150*b* is an opening through which holding grooves 140*b* communicate with the outside of the male body 100*b*. The male terminals 200*b* can be detachably inserted through the open portion 150*b* into the associated holding grooves 140*b*. The male connector C1*b* may further include a lid 300*b* for closing the open portion 150*b*. In the embodiment of FIGS. 1A to 1D and FIGS. 3A to 3D, the open portion 150*b* is provided in the Z'-direction face of the male body 100*b*, and the lid 300*b* closes the open portion 150*b* from the Z'-direction side. The lid 300*b* may include a lid body 310*b* and an engagement piece 320*b* provided at the lid body 310*b*, and the male body 100*b* may further include an engagement hole 160*b*. In this case, it is preferable that the engagement piece 320*b* engage with the engagement hole 160*b*, and that the lid body 310*b* close the open portion 150*b*. The lid 300*b* may be made of a metal, a plastic material, or any other suitable material. If the lid 300*b* is made of a metal plate, the male connector C1*b* may further include an insulating sheet 400*b* to be disposed between the lid 300*b* and the male terminals 200*b*.

The open portion 150*b* may be omitted. In this case, any one of or any combination of the following configurations (1) to (3) may be adopted but not limited thereto. (1) The holding grooves 140*b* open to the outside of the male body 100*b*. (2) The lid 300*b* closes the holding grooves 140*b*. 3) The insulating sheet 400*b* is disposed between the lid 300*b* and the male terminals 200*b*. Irrespective of whether the open portion 150*b* is omitted or not, if there a low risk of the short circuit between the lid 300*b* and the male terminals 200*b*, the insulating sheet 400*b* can be omitted.

The female connector C1*a* may further include a pair of covers 130*a*, namely an X-direction-side cover 130*a* and an X'-direction-side cover 130*a*. The pair of support portions 120*a* is comprised of an X-direction-side support portion 120*a* and an X'-direction-side support portion 120*a*. The X-direction-side cover 130*a* extends in the X' direction from the X-direction-side support portion 120*a*. The X'-direction-side cover 130*a* extends in the X direction from the X'-direction-side support portion 120*a*. The covers 130*a* may preferably have at least one of the following configurations (4) and (5). (4) The covers 130*a* cover the female body 200*a* from the Z-direction side. (5) The covers 130*a* abuts the female body 200*a* from the Z-direction side. In case (5), the covers 130*a* function as a pair of second abutment portions as defined in the claims. The opposing ends of the covers 130*a* may be opposed to each other with a clearance therebetween or in contact with each other. The covers 130*a* may be coupled to each other. In the configuration as shown in FIG. 1A to FIG. 2D, the covers 130*a* have the configurations (4) and (5), and the opposing ends of the covers 130*a* are in contact with each other.

The guide 110*a* of the female connector C1*a* may further include at least one bottom 112*a*. The or each bottom 112*a* may be provided between and couple together the associated pair of rails 111*a* of the frame of the guide 110*a*. Alternatively, the or each bottom 112*a* may be the bottom of the associated rail groove of the guide 110*a*, and be provided between the rails 111*a* of the rail groove. The at least one bottom 112*a* may extend in the Y-Y' direction. Alternatively, a plurality of bottoms 112*a* may be arranged in spaced relation in the Y-Y' direction. The at least one bottom 112*a* may preferably be located on the Z'-direction side relative to the contact portions 310*a* of the female terminals 300*a*. In the embodiment of FIG. 1A to FIG. 2D, there is one bottom 112*a* extending in the Y-Y' direction and coupling between the rails 111*a* of the frame of the guide 110*a*.

The one or each bottom 112*a* may have an opening 113*a* passing in the Z-Z' direction through the Y-direction-side end portion of the bottom 112*a*. The or each opening 113*a* may be located on the Z'-direction side of the female connection portion of the female connector C1*a* as shown in FIG. 1A to FIG. 2D, or on the Y'-direction side relative to the female connection portion of the female connector C1*a*. The opening 113*a* may be omitted.

One of the following configurations (1) to (3) may be adopted but not limited thereto.

(1) If the female connector C1*a* includes the guide 110*a* being a frame having a pair of rails 111*a* and a bottom 112*a* and also includes a pair of support portions 120*a*, then the rails 111*a*, the bottom 112*a*, and the support portions 120*a* may be formed as a single integral member, such as a sheet metal, a metal member, or a plastic member.

(2) If the female connector C1*a* includes the guide 110*a* being a frame having a pair of rails 111*a* and also includes a pair of support portions 120*a* and covers 130*a*, then the rails 111*a*, the support portions 120*a*, and the covers 130*a* may be formed as a single integral member, such as a sheet metal, a metal member, or a plastic member. In this case, the covers 130*a* may preferably be coupled to each other.

(3) If the female connector C1*a* includes the guide 110*a* being a frame having a pair of rails 111*a* and a bottom 112*a* and also includes a pair of support portions 120*a* and a pair of covers 130*a*, then the rails 111*a*, the bottom 112*a*, the support portions 120*a*, and the covers 130*a* may be formed as a single integral member, such as a sheet metal, a metal member, or a plastic member.

In the embodiment of FIG. 1A to FIG. 2D, the rails 111*a* of the frame, the bottom 112*a* of the frame, the support portions 120*a*, and the covers 130*a* are formed as a single sheet metal. As discussed above, the covers 130*a* and/or the bottom 112*a* may be omitted.

The female connector C1*a* may further include a female biasing portion 500*a*. The female biasing portion 500*a* is only required to be fixed to the at least one bottom 112*a* to bias the male connector C1*b* to the Z-direction side when the male connector C1*b* is guided by the guide 110*a*. The female biasing portion 500*a* may be a plate spring, a coil spring, a rubber, or any other elastic body that is fixed to the at least one bottom 112*a*. For example, as in the embodiment of FIG. 1A to FIG. 2D, the female biasing portion 500*a* may include an engagement arm 510*a*, a pair of biasing arms 520*a*, and a base 530*a*. The engagement arm 510*a* extends in the Y direction from the center of the base 530*a*. The biasing arms 520*a* extend in the Y direction from ends in the X-X' direction of the base 530*a*. The bottom 112*a* of the guide 110*a* is provided with an engagement portion 114*a* and a pair of cutouts 115*a*. The engagement portion 114*a* has an insertion hole and a bridge. The insertion hole of the engagement portion 114*a* passes in the Z-Z' direction through the bottom 112*a*. The bridge of the engagement portion 114*a* bridges between the X- and X'-direction edges of the insertion hole. The engagement arm 510*a* is received in the insertion hole from the Z'-direction side of the bottom 112*a* and engages with the bridge from the Z-direction side. The base 530*a* abuts the bottom 112*a* from the Z'-direction side. The cutouts 115*a* pass through the bottom 112*a* in the Z-Z' direction. Distal ends of the biasing arms 520*a* are placed through the respective cutouts 115*a* and into the guide 110*a* from the Z'-direction side.

The female biasing portion 500*a* can bias the male connector C1*b* in the Z direction so as to bring the contact portions 210*b* of the male terminals 200*b* of the male connector C1*b* into elastic contact with the associated contact portions 310*a* of the female terminals 300*a* of the female connector C1*a* in any of the following cases (1) to (3): (1) the contact portions 210*b* are exposed or protrude in the Z direction out of the male connection portion 130*b*, and the contact portions 310*a* are exposed or protrude in the Z' direction out of the female connection portion; (2) the contact portions 210*b* of are located in the male connection hole, and the contact portions 310*a* are exposed or protrude in the Z' direction out of the female connection portion; or (3) the contact portions 210*b* are exposed or protrude in the Z direction out of the male connection portion 130*b*, and the contact portions 310*a* are located in the female connection hole.

If the female connector C1*a* includes the covers 130*a* to abut the female body 200*a* from the Z-direction side, the female biasing portion 500*a* biases the male connector C1*b* in the Z direction and thereby presses the male connector C1*b* and the female body 200*a* onto the covers 130*a*. In other words, the male connector C1*b* and the female body 200*a* are elastically held by and between the covers 130*a* and the female biasing portion 500*a*. This arrangement suppresses backlash in the Z-Z' direction of the male connector C1*b* when located in the connection position.

The guide 110*a* of the female connector C1*a* may include a pair of first abutment portions 111*a*1. The first abutment portions 111*a*1 is only required to be abuttable from the Z'-direction side by the runner 120*b* of the male connector C1*b* biased in the Z direction by the female biasing portion 500*a*. Particularly, the first abutment portions 111*a*1 may have one of the following configurations (1) to (3) but not limited thereto. (1) The first abutment portions 111*a*1 are bent portions of the guide 110*a* bent such that the rails 111*a* of the frame of the guide 110*a* come closer to each other, and the bent portions are located on the Z-direction side relative to the runner 120*b*. (2) The first abutment portions are elongate protrusions on the rails 111*a* of the frame of the guide 110*a*, protrude in directions closer to each other, and are located on the Z-direction side relative to the runner 120*b*. (3) The first abutment portions 111*a*1 are elongate projections extending along the rails 111*a* of the rail grooves of the guide 110*a*, protrude in directions closer to each other, and are located on the Z-direction side relative to the runner 120*b*. In the embodiment of FIG. 1A to FIG. 2D, the first abutment portions 111*a*1 are the bent portions. In any configuration (1) to (3) of the first abutment portions 111*a*1, the biasing force of the female biasing portion 500*a* presses the runner 120*b* of the male connector C1*b* onto the first abutment portions 111*a*1. In other words, the male connector C1*b* is elastically held by and between the first abutment portions 111*a*1 and the female biasing portion 500*a*. This arrangement suppresses backlash in the Z-Z' direction of the male connector C1*b* when located in the connection position. It should be noted that the female connector C1*a* may include the first abutment portions 111*a*1 only, or the second biasing portions only, or both the first and second abutment portions, or neither the first abutment portions 111*a*1 nor the second biasing portions.

The guide 110*a* of the female connector C1*a* may further include a female engagement portion 116*a*. The female engagement portion 116*a* may preferably be an engagement hole that is provided in the guide 110*a* and extends in the X-X' direction. In the embodiment of FIG. 1A to FIG. 2D, the female engagement portion 116*a* is an engagement hole passing in the X-X' direction through the rails 111*a* on the X'-direction side.

The male connector C1*b* may further include a male engagement portion 500*b* and a male biasing portion 600*b*. The male engagement portion 500*b* is an engagement block. The male biasing portion 600*b* is an elastic body, such as a coil spring or a rubber. The male body 100*b* of the male connector C1*b* may further include an accommodation portion 170*b*. The accommodation portion 170*b* may preferably be a recess extending in the X-X' direction in the male body 100*b* and opening such as to communicate with the female engagement portion 116*a* when the male connector C1*b* is in the connection position. The male engagement portion 500*b* is accommodated in the accommodation portion 170*b* such as to be movable in the X-X' direction. The male biasing portion 600*b* is disposed in the accommodation portion 170*b*, particularly between a wall of the accommodation portion 170*b* and the male engagement portion 500*b*, and biases the male engagement portion 500*b* in one of the X and X' directions (the X' direction in the embodiment of FIGS. 1A to 1E and FIGS. 3A to 3D). The male engagement portion 500*b* may have a tapered face 510*b*. In this case, when the runner 120*b* of the male connector C1*b* is guided by the guide 110*a* of the female connector C1*a*, the tapered face 510*b* abuts on one of the first abutment portions 111*a*1 of the guide 110*a*, allowing the male engagement portion 500*b* to move in the other of the X and X' directions (the X direction in the embodiment of FIGS. 1A to 1E and FIGS. 3A to 3D) against a biasing force of the male biasing portion 600*b*. Alternatively, when the runner 120*b* of the male connector C1*b* is guided by the guide 110*a* of the female connector C1*a*, a user may manually move the male engagement portion 500*b* in the other of the X and X' against the biasing force of the male biasing portion 600*b*. In either case, when the male connector C1*b* guided by the guide 110*a* has moved to the connection position, the accommodation portion 170*b* of the male connector C1*b* communicates with the female engagement portion 116*a* of the female connector C1*a*. Then the male engagement portion 500*b*, subjected to a biasing force of the male biasing portion 600*b*, is inserted into and engaged with the female engagement portion 116*a*. An edge of the opening of the accommodation portion 170*b* may be provided with a restricting portion configured to abut on a portion of the male engagement portion 500*b* and thereby restrict the male engagement portion 500*b* to move in the X or X' direction beyond the specified range.

The male connector C1*b* may further include a fixation member 700*b* and a pin or screw 800*b*. The fixation member 700*b* is fixed to the male body 100*b* such as to at least partially cover the male engagement portion 500*b* and the male biasing portion 600*b* from the Z-direction side. The pin or screw 800*b* fixes the fixation member 700*b* to the male body 100*b*. In the embodiment of FIGS. 1A to 1E and FIGS. 3A to 3D, the fixation member 700*b* has a generally of U-shaped cross-section in the Z-Z' direction, with its two legs respectively received in slits in the male body 100*b*. The pin or screw 800*b* extends through the fixation member 700*b* and fittingly or threadedly engaged with a hole of the male body 100*b*.

The female engagement portion 116*a* and the male engagement portion 500*b* may be configured as described above or as described below. One of the female engagement portion 116*a* and the male engagement portion 500*b* may be an engagement hole, and the other may be an engagement protrusion. The engagement protrusion may preferably engages with the engagement hole when the male connector C1*b* is in the connection position. In this case, the male biasing portion 600*b* may be omitted. If there is no need to fix the male connector C1*b* in position with respect to the female connector C1*a* when the male connector C1*b* is in the connection position, it is then possible to omit the female engagement portion 116*a*, the male biasing portion 600*b*, and the male biasing portion 600*b*.

The female connector C1*a* as shown in FIG. 1A to FIG. 2D may be fabricated in the following steps. First, a sheet metal is pressed into form. Particularly, the pair of rails 111*a* of the guide 110*a* and the pair of support portions 120*a* contiguous with the rails 111*a* are bend relative to the bottom 112*a* such as to extend in the Z direction, and the cover 130*a* on the X-direction side is bent relative the support portion 120*a* on the X-direction side such as to extend in the X' direction, and the cover 130*a* on the X'-direction side is bent relative to the support portion 120*a* on the X'-direction side such as to extend in the X direction. Also, the plurality of female terminals 300*a* are prepared and insert-molded into the female body 200*a*. The female terminals 300*a* are thus held in the female body 200*a*, in spaced relation from each other in the X-X' direction. The shaft 400*a* is also prepared. The female body 200*a* is disposed between the support portions 120*a* and in contact with the covers 130*a*, so that the through hole 211*a* of the female body 200*a* communicate with the support holes 121*a* of the support portions 120*a*. In this state, the shaft 400*a* is inserted into the support holes 121*a* of the support portions 120*a* and the through hole 211*a* of the female body 200*a*. As a result, the female body 200*a* and the female terminals 300*a* held therein are supported by the shaft 400*a* such as to be floatable along the X-X' direction between the support portions 120*a*. Then, the female biasing portion 500*a* is prepared. The engagement arm 510*a* of the female biasing portion 500*a* is brought into engagement with the engagement portion 114*a* of the bottom 112*a*, and the distal ends of the pair of biasing arms 520*a* of the female biasing portion 500*a* are inserted from the Z'-direction side through the respective cutouts 115*a* of the bottom 112*a* and then into the guide 110*a*. The female connector C1*a* has thus been fabricated. Then, the tails 320*a* of the female terminals 300*a* are connected to a female circuit board. The face on the Z'-direction side of the bottom 112*a* of the female connector C1*a* may be fixed to a case (not shown, hereinafter referred to as a female case). The female case may preferably have an opening to accommodate the female circuit board. The female case may also accommodate at least one electronic component mounted or connected to the female circuit board.

The male connector C1*b* as shown in FIGS. 1A to 1E and FIGS. 3A to 3D may be fabricated in the following steps. First, the male body 100*b* is molded from a plastic material. The male body 100*b* is molded together with the runner 120*b*. The male terminals 200*b* are prepared. The male terminals 200*b* are placed through the open portion 150*b* of the male body 100*b* into the associated holding grooves 140*b*. Accordingly, the tails 220*b* of the male terminals 200*b* protrude in the Z direction out of the holding grooves 140*b*, and the distal ends of the contact portions 310*a* of the male terminals 200*b* protrude out of the holding grooves 140*b* such as to be located inside the recess 131*b* of the male connection portion 130*b*. The insulating sheet 400*b* is also prepared. The insulating sheet 400*b* is inserted into the open portion 150*b* of the male body 100*b* so as to cover the male terminals 200*b*. The lid 300*b* is also prepared. The engagement piece 320*b* of the lid 300*b* is inserted for engagement into the engagement hole 160*b* of the male body 100*b*, and the lid body 310*b* of the lid 300*b* closes the open portion 150*b*. Also, the male engagement portion 500*b* and the male biasing portion 600*b* are prepared and placed into the accommodation portion 170*b* of the male body 100*b*. At this time, the male biasing portion 600*b* is disposed between the male engagement portion 500*b* and the wall on the X-direction side of the accommodation portion 170*b*. The male biasing portion 600*b* thus biases the male engagement portion 500*b* in the X' direction. The fixation member 700*b* is also prepared. The legs of the fixation member 700*b* are respectively inserted the slits of the male body 100*b*. The fixation member 700*b* thus covers the male engagement portion 500*b* and the male biasing portion 600*b* partially from the Z-direction side. The pin or screw 800*b* is also prepared. The pin or screw 800*b* is used to fasten the fixation member 700*b* to the male body 100*b*. The male connector C1*b* has thus been fabricated. Then, the tails 220*b* of the male terminals 200*b* are connected to the male circuit board Pb. The male body 100*b* of the male connector C1*b* may be fixed to a case (not shown, hereinafter referred to as a male case). If the male case is provided, located outside of the male case are the runner 120*b*, the Z'-direction end portion of the male body 100*b*, and the Z'-direction end portion of the male biasing portion 600*b*. The male case may accommodate the male circuit board Pb and at least one electronic component mounted or connected thereto.

The male connector C1*b* and the female connector C1*a* fabricated as described above may be connected to each other in the following steps. The runner 120*b* of the male connector C1*b* is inserted in between the rails 111*a* of the guide 110*a* of the female connector C1*a*, and the runner 120*b* is then moved in the Y-Y' direction from the initial position to the connection position in such a manner to be floatable in the X-X' direction between the rails 111*a*. During the movement of the runner 120*b*, the tapered face 510*b* of the male engagement portion 500*b* of the male connector C1*b* is pressed onto the first abutment portion 111*a*1 of the X'-direction-side rail 111*a* of the female connector C1*a*. This pressing force moves the male engagement portion 500*b* in the X direction against the biasing force of the male biasing portion 600*b*. On the other hand, the biasing arms 520*a* of the female biasing portion 500*a* of the female connector C1*a* bias the male connector C1*b* in the Z direction. This biasing force brings the runner 120*b* of the male connector C1*b* into abutment with the first abutment portions 111*a*1 of the rails 111*a* of the female connector C1*a* from the Z'-direction side. Once the male connector C1*b* is placed in the connection position, the accommodation portion 170*b* of the male connector C1*b* communicates with the female engagement portion 116*a* of the female connector C1*a*, and the male engagement portion 500*b* is moved in the X' direction by the biasing force of the male biasing portion 600*b* and brought into engagement with the female engagement portion 116*a*. Simultaneously, the male connection portion 130*b* of the male connector C1*b* is received into the female connection hole of the female connector C1*a*, and the tongue 222*a* (female connection portion) of the female connector C1*a* is received into the recess 131*b* (male connection hole) of the male connection portion 130*b* of the male connector C1*b*. In this arrangement in which the male connector C1*b* is biased by the female biasing portion 500*a*, the contact portions 210*b* of the male terminals 200*b* protruding in the Z direction out of the male connection portion 130*b* are brought into elastic contact with the contact portions 310*a* of the female terminals 300*a*, which are exposed in the Z' direction out of the tongue 222*a* of the female connector C1*a*. This establishes electrical connection between the male connector C1*b* and the female connector C1*a*, i.e. completes the assembly of the connection structure S1 of the male connector C1*b* and the female connector C1*a*.

The connection structure S1 described above has at least the following technical features. First, the connection structure S1 has a reduced number of components for the floating structure of the female connector C1*a* because of a simple configuration (1) or (2). (1) The shaft 400*a* is received in the support holes 121*a* of the support portions 120*a* and the at least one through hole 211*a* of the female body 200*a*, such that the female body 200*a* is supported by and between the support portions 120*a* such as to be floatable along the X-X' direction. (2) Alternatively, the shaft 400*a* is fixed to the female body 200*a* such as to extend in the X-X' direction through at least a portion of the female body 200*a* and is received in the support holes 121*a* of the support portions 120*a* such as to be floatable along the X-X' direction.

Second, if including the covers 130*a* and the bottom 112*a*, the female connector C1*a* reduces the risk that a user may touch the contact portions 310*a* of the female terminals 300*a*. This is because the covers 130*a* of the female connector C1*a* cover the female body 200*a* from the Z-direction side, and because, although the contact portions 310*a* of the female terminals 300*a* are exposed in the Z'-direction out of the tongue 222*a* of the female body 200*a*, the bottom 112*a* of the guide 110*a* of the female connector C1*a* is located on the Z'-direction side relative to the contact portions 310*a*.

Third, if the female connector C1*a* includes the covers 130*a* and/or the guide 110*a* with the first abutment portions 111*a*1, the connection structure S1 minimizes backlash in the Z-Z' direction of the male connector C1*b* at the connection position so as to stabilize the connection between the female connector C1*a* and the male connector C1*b*. The reason for this is as follows. When the runner 120*b* of the male connector C1*b* is guided by the guide 110*a* and has moved to the connection position, the male connector C1*b* is biased in the Z direction by the female biasing portion 500*a* of the female connector C1*a*. Due to this biasing force, the runner 120*b* of the male connector C1*b* is brought into abutment, from the Z'-direction side, with the first abutment portions 111*a*1 of the female connector C1*a;* and/or the contact portions 210*b* of the male terminals 200*b* of the male connector C1*b* are brought into elastic contact, from the Z'-direction side, with the contact portions 310*a* of the female terminals 300*a* of the female connector C1*a*. In other words, the male connector C1*b* is elastically held in the Z-Z' direction by and between the female biasing portion 500*a* and the first abutment portions 111*a*1 of the female connector C1*a*, and/or the male connector C1*b* and the female body 200*a* are elastically held in the Z-Z' direction by and between the female biasing portion 500*a* and the covers 130*a*. This arrangement reduces backlash in the Z-Z' direction of the male connector C1*b* in the connection position and thereby stabilizes the connection between the female connector C1*a* and the male connector C1*b*.

Fourth, if the guide 110*a* of the female connector C1*a* includes the bottom 112*a* with the opening 113*a*, the connection structure S1 is suitably configured for readily removing unwanted materials (e.g. dust, lint, dirt, etc.) accumulated on the bottom 112*a* of the guide 110*a*. Particularly, when the runner 120*b* of the male connector C1*b* is guided by the rails 111*a* of the guide 110*a*, the runner 120*b* pushes unwanted materials on the bottom 112*a* outwardly in the Y direction and eject them through the opening 113*a* of the bottom 112*a*.

Fifth, if the male connector C1*b* includes the male body 100*b* with the accommodation portion 170*b*, the male engagement portion 500*b*, and the male biasing portion 600*b*, and if the guide 110*a* of the female connector C1*a* includes the female engagement portion 116*a*, the connection structure S1 provides an automatic mechanism by which the male connector C1*b* in the connection position is securely positioned relative to the female connector C1*a*. This is because, in the connection position, the accommodation portion 170*b* of the male connector C1*b* communicates with the female engagement portion 116*a* of the female connector C1*a*, and the male engagement portion 500*b* biased by the male biasing portion 600*b* is engaged with the female engagement portion 116*a*.

Sixth, if the guide 110*a* of the female connector C1*a*, the support portions 120*a*, and the covers 130*a* are formed of a sheet metal, and the shaft 400*a* is made of metal, the connection structure S1 has improved resistance against load imposed when the runner 120*b* of the male connector C1*b* is twisted inside the guide 110*a* of the female connector C1*a*.

Figure 4:
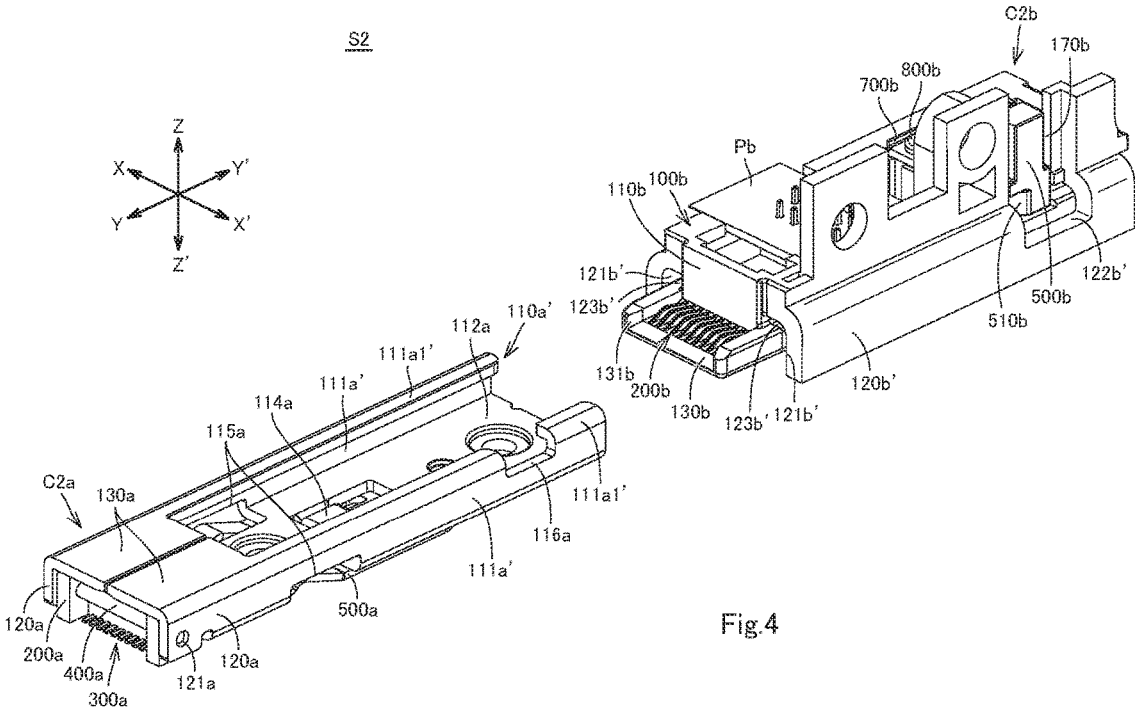
FIG. 4 is a front, top, right side perspective view of a connection structure of the second embodiment of the invention, in which the male connector is yet to be connected to the female connector.

A connection structure S2 according to some other embodiments of the invention will be described below in detail with reference to FIG. 4. FIG. 4 shows an embodiment (hereinafter referred to as the second embodiment) of the connection structure S2. The connection structure S2 includes a female connector C2*a* and a male connector C2*b*. The Y-Y' direction, the X-X' direction, and the Z-Z' direction are defined as shown in FIG. 4, in the same manner as in the first embodiment.

The male connector C2*b* has the same configuration as that of the male connector C1*b*, except that the male connector C2*b* includes a runner 120*b*' of different configuration from that of the runner 120*b* of the male connector C1*b*. The difference will be described below in detail, and redundant descriptions of the male connector C2*b* will not be repeated.

Preferably, the runner 120*b*' may be of any configuration as long as it can be guided movably in the Y-Y' direction by a guide 110*a*' (to be described) of the female connector C2*a* such as to be floatable along the X-X' direction. For example, the runner 120*b*' may include at least one runner groove 121*b*' extending in the Y-Y' direction. The runner

120*b*' may be integrally provided at any suitable position of the male main body 110*b*. Alternatively, the runner 120*b*' may be formed separately from the male main body 110*b* and fixed to any suitable position of the male main body 110*b*.

In the embodiment of FIG. 4, the runner 120*b*' is a rectangular plate extending in the X-X' and Y-Y' directions and being integral with the Z'-direction end of the male main body 110*b*. The runner 120*b*' has a pair of runner grooves 121*b*', the length of which extends in the Y-Y' direction in spaced relation to each other in the X-X' direction. The runner grooves 121*b*' are symmetrically shaped in the X-X' direction, rising in the Z direction and then curves in directions closer to each other.

The female connector C2*a* has the same configuration as that of the female connector C1*a*, except that the female connector C2*a* includes a guide 110*a*' of different configuration from that of the guide 110*a* of the female connector C1*a*. The difference will be described below in detail, and redundant descriptions of the female connector C2*a* in this embodiment will not be repeated.

The guide 110*a*' of the female connector C2*a* extends in the Y-Y' direction. The guide 110*a*' includes at least one rail 111*a*' extending in the Y-Y' direction. The or each rail 111*a*' may be of any configuration as long as it is receivable in the associated runner groove 121*b*' of the runner 120*b*' of the male connector C2*b* with clearance in the X-X' direction and movable in the Y-Y' direction in and along the associated runner groove 121*b*'. More specifically, the or each rail 111*a*' may preferably have an X-X' direction dimension that is slightly smaller than that of the or each runner groove 121*b*' of the runner 120*b*'.

The female connector C2*a* as shown in FIG. 4 has substantially the same configuration as that of the female connector C1*a* as shown in FIG. 1A to FIG. 2D. The differences are that the guide 110*a*' of the female connector C2*a* includes a pair of rails 111*a*'of shape corresponding to the pair of runner grooves 121*b*', and the rails 111*a*' are received in the associated runner grooves 121*b*' with clearance in the X-X' direction and movable in the Y-Y' direction in and along the runner grooves 121*b*'. The pair of rails 111*a*' may or may not include first abutment portions 111*a*1', which may be bent portions.

The guide 110*a*' may include three or more rails 111*a*', and the runner 120*b*' may accordingly include three or more runner grooves 121*b*'.

The support portions 120*a* are provided on the Y-direction side relative to the guide 110*a*' and are spaced from each other in the X-X' direction. For example, the support portions 120*a* may extend in the Y direction from the respective Y-direction ends of the pair of rails 111*a*' of the guide 110*a*'. For further details of the support portions 120*a*, reference should be made to the support portions 120*a* of the female connector C1*a* described above.

The guide 110*a*' of the female connector C2*a* may further include at least one bottom 112*a*. The bottom 112*a* may be may be provided between and couple together the pair of rails 111*a*' of the guide 110*a*'. For further details of the bottom 112*a*, reference should be made to the bottom 112*a* of the female connector C1*a* described above.

If the female connector C2*a* includes the guide 110*a*' having the rails 111*a*' with the first abutment portions 111*a*1' and further includes the female biasing portion 500*a*, the runner 120*b*' of the male connector C2*b* may further include flanges 123*b*' extending along the edges of the runner grooves 121*b*'. The flanges 123*b*' are located on the Z'-direction side relative to the first abutment portions 111*a*1' when the rails 111*a*' are received in the runner grooves 121*b*'. When the male connector C2*b* is biased in the Z-direction by the female biasing portion 500*a*, the flanges 123*b*' of the runner 120*b*' abut on the first abutment portions 111*a*1' from the Z'-direction side.

If the male connector C2*b* further includes the male engagement portion 500*b* and the male biasing portion 600*b*, the male connector C2*b* is configured as follows. One of the runner grooves 121*b*' (the runner groove 121*b*' on the X'-direction side in the embodiment of FIG. 4) of the runner 120*b*' communicates with the accommodation portion 170*b* of the male body 100*b*. The male engagement portion 500*b* of the male connector C2*b* has a tapered face 510*b*, which is located in the one of the runner grooves 121*b*' and is configured to be pressed onto one of the first abutment portions 111*a*1' of the pair of rails 111*a*'. The runner 120*b*' may preferably be provided with a cutout 122*b*' that allows the male engagement portion 500*b* to move in the X-X' direction. The cutout 122*b*' communicates with the one of the runner grooves 121*b*' and the accommodation portion 170*b*.

The female connector C2*a* as shown in FIG. 4 may be fabricated in the same manner as the female connector C1*a* as shown in FIGS. 1A to FIG. 2D. The male connector C2*b* as shown in FIG. 4 may be fabricated in the same manner as the male connector C1*b* as shown in FIGS. 1A to 1E and FIGS. 3A to 3D, except that the male body 100*b* of the male connector C2*b* is molded from plastic material together with the runner 120*b*' in place of the runner 120*b*.

The male connector C2*b* and the female connector C2*a* fabricated as described above may be connected to each other in the following steps. The rails 111*a*' of the guide 110*a*' of the female connector C2*a* are respectively inserted into the runner grooves 121*b*' of the runner 120*b*' of the male connector C2*b*, and the runner 120*b*' is moved along the rails 111*a*' from the initial position to the connection position is such a manner as to be floatable along the X-X' direction. During the movement of the runner 120*b*', the tapered face 510*b* of the male engagement portion 500*b* of the male connector C2*b* is pressed, inside the runner groove 121*b*' on the X'-direction side, onto the first abutment portion 111*a*1' of the X'-direction side rail 111*a*'of the female connector C2*a*. This pressing force moves the male engagement portion 500*b* in the X direction against the biasing force of the male biasing portion 600*b*. On the other hand, the biasing arms 520*a* of the female biasing portion 500*a* of the female connector C2*a* bias the male connector C2*b* in the Z direction. This biasing force brings the flanges 123*b*' of the runner grooves 121*b*' of the runner 120*b*' of the male connector C2*b* into abutment with the associated first abutment portions 111*a*1' of the rails 111*a*' of the female connector C2*a* from the Z'-direction side. Once the male connector C2*b* is placed in the connection position, the accommodation portion 170*b* of the male connector C2*b* communicates with the female engagement portion 116*a* of the female connector C2*a*, and the male engagement portion 500*b* is moved in the X' direction by the biasing force of the male biasing portion 600*b* and brought into engagement with the female engagement portion 116*a*. Simultaneously, the male connection portion 130*b* of the male connector C2*b* is received into the female connection hole of the female connector C2*a*, and the tongue 222*a* (female connection portion) of the female connector C2*a* is received into the recess 131*b* (male connection hole) of the male connection portion 130*b* of the male connector C2*b*. In this arrangement in which the male connector C2*b* is biased by the female biasing portion 500*a*, the contact portions 210*b* of the male terminals 200*b* protruding in the Z direction out of the male connection portion 130*b* are brought into elastic contact with the contact portions 310*a* of the female terminals 300*a* exposed in the Z' direction out of the tongue 222*a* of the female body 200*a* of the female connector C2*a*. This establishes electrical connection between the male connector C2*b* and the female connector C2*a*, i.e. completes the assembly of the connection structure S2 of the male connector C2*b* and the female connector C2*a*.

The connection structure S2 described above has at least the first to sixth technical features described in connection with the connection structure S1.

The connection structure, the female connector, and the male connector described above are not limited to the above embodiments but can be modified in any manner within the scope of the claims. Specific modifications will be described below.

The floating structure of the female connector of any aspect described above may be modified to any structure described below. A female body 200*a*' is disposed between a pair of support portions 120*a*'. The female body 200*a*' may include a female main body 220*a*', and at least one opposing portion 230*a*' opposed to the pair of support portions 120*a*'. The at least one opposing portion 230*a*' may be part of the female main body 220*a*', may extend from the female main body 220*a*', or may be fixed to the female main body 220*a*'.

More specifically, the floating structure may have one of the following configurations (1) to (4):

(1) The female body 200*a*' includes one opposing portion 230*a*', and a pair of shaft parts 410*a*' is provided. One of the shaft parts 410*a*' extends in the X direction from the X-direction end face of the opposing portion 230*a*' to be received in a support hole 420*a*' of the support portion 120*a*' on the X-direction side such as to be floatable along the X-X' direction. The other shaft part 410*a*' extends in the X' direction from the X'-direction end face of the opposing portion 230*a*' to be received in a support hole 420*a*' of the support portion 120*a*' on the X' direction side such as to be floatable along the X-X' direction.

(2) The female body 200*a*' includes one opposing portion 230*a*', the opposing portion 230*a*' has at least one support hole 420*a*' extending in the X-X' direction, and a pair of shaft parts 410*a*' is provided. One of the shaft parts 410*a*' extends in the X' direction from the support portion 120*a*' on the X-direction side to be received in a support hole 420*a*' such as to be floatable along the X-X' direction. The other shaft part 410*a*' extends in the X direction from the support portion 120*a*' on the X'-direction side to be received in the or another support hole 420*a*' such as to be floatable along the X-X' direction.

(3) The female body 200*a*' includes a pair of opposing portions 230*a*', and a pair of shaft parts 410*a*' is provided. The shaft parts 410*a*' extends respectively from the opposing portions 230*a*', and the pair of support portions 120*a* is provided with a pair of support hole 420*a*' to receive the shaft parts 410*a*' in a floatable manner in the X-X' direction.

(4) The female body 200*a*' includes a pair of opposing portions 230*a*', and a pair of shaft parts 410*a*' is provided. The shaft parts 410*a*' extends respectively from the pair of support portions 120*a*, and the pair of opposing portions 230*a*' is provided with a pair of support hole 420*a*' to receive the shaft parts 410*a*' in a floatable manner in the X-X' direction.

Figure 5:
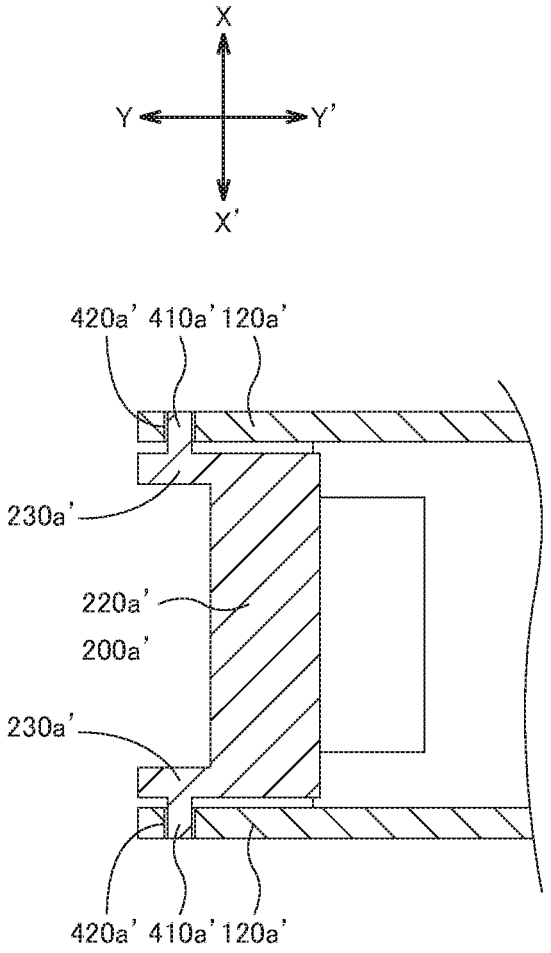
FIG. 5 is a view of a variant female connector of the connection structures of the first and second embodiments.

In the embodiment of FIG. 5, the female body 200*a*' includes a pair of opposing portions 230*a*' extending in the Y direction from the X- and X'-direction ends of the Y-direction end face of the female main body 220*a*', and a pair of shaft parts 410*a*' extends in the X- and X' directions, respectively, from the opposing portions 230*a* to be received in associated support holes 420*a*' of the pair of support portions 120*a* such that the shaft parts 410*a*' are floatable along the X-X' direction. In FIG. 5, the female terminals 300*a* are not shown for convenience of illustration, and the Y-Y' and X-X' directions are defined as in the first embodiment. As described above, the shaft parts 410*a*' in this embodiment are supported in the support holes 420*a*' such as to be floatable along the X-X' direction, so that the female body 200*a*' and the female terminals 300*a* are supported between the support portions 120*a*' such as to be floatable along the X-X' direction. Including a floating structure of any aspect described above, the female connector of the invention may have any configuration described above. Further, the/or each shaft part 410*a*' may be a metal shaft. The support portions 120*a*' may be part of a metal plate.

The female body of any aspect described above may be covered with a shield case. The male body of any aspect described above may be also covered with a shield case. In this case, the runner may be part of the shield case.

It should be appreciated that the above embodiments and variants of the connection structure and the female and male connectors are described above by way of examples only. The materials, shapes, dimensions, numbers, arrangements, and other configurations of the constituents of the connection structure and the female and male connectors may be modified in any manner if they can perform similar functions. The configurations of the embodiments and the variants described above may be combined in any possible manner. The first direction of the invention may be any direction in which the guide guides the male connector. The second direction of the invention may be any direction orthogonal to the first direction of the invention. The third direction of the invention may be any direction orthogonal to the first and second directions of the invention.

The entire contents of all references cited in this disclosure are incorporated herein in their entireties, by reference. Further, when an amount, concentration, or other value or parameter is given as either a range, preferred range, or a list of upper preferable values and lower preferable values, this is to be understood as specifically disclosing all ranges formed from any pair of any upper range limit or preferred value and any lower range limit or preferred value, regardless of whether such ranges are separately disclosed. Where a range of numerical values is recited herein, unless otherwise stated, the range is intended to include the endpoints thereof, and all integers and fractions within the range. It is not intended that the scope of the invention be limited to the specific values recited when defining a range.

Other embodiments of the present invention will be apparent to those skilled in the art from consideration of the present specification and practice of the present invention disclosed herein. It is intended that the present specification and examples be considered as exemplary only with a true scope and spirit of the invention being indicated by the following claims and equivalents thereof.

REFERENCE SIGNS LIST

S1: Connection structure
C1*a*: Female connector
110*a*: Guide
111*a*: Rail
111*a*1: First contact portion
112*a*: Bottom
113*a*: Opening

120*a*: Support portion
121*a*: Support hole
130*a*: Cover (Second contact portion)
200*a*: Female body
210*a*: Wing
211*a*: Through hole
220*a*: Female main body
221*a*: Base
222*a*: Tongue
300*a*: Female terminal
310*a*: Contact portion
320*a*: Tail
400*a*: Shaft
500*a*: Female biasing portion
510*a*: Engagement arm
520*a*: Biasing arm
530*a*: Base
C1*b*: Male connector
100*b*: Male body
110*b*: Male main body
120*b*: Runner
130*b*: Male connection portion
131*b*: Recess (Male connection hole)
140*b*: Holding groove
150*b*: Opening portion
160*b*: Engagement hole
170*b*: Accommodation portion
200*b*: Male terminal
210*b*: Contact portion
220*b*: Tail
230*b*: Base
300*b*: Lid
310*b*: Lid body
320*b*: Engagement piece
400*b*: Insulating sheet
500*b*: Male engagement portion
600*b*: Male biasing portion
700*b*: Fixation member
800*b*: Pin or screw
S2: Connection structure
C2*a*: Female connector
110*a*': Guide
111*a*': Rail
111*a*': First contact portion
C2*b*: Male connector
120*b*': Runner
121*b*': Runner groove
122*b*': Cutout
123*b*': Flange

What is claimed is:

1. A female connector for mating with a male connector, the female connector comprising:

a guide extending in a first direction, the guide being configured to guide the male connector in the first direction such that the male connector is floatable along a second direction, the second direction being orthogonal to the first direction;

a pair of support portions on one side in the first direction relative to the guide, the support portions being spaced from each other in the second direction and each having a support hole passing therethrough in the second direction;

a female body being insulative and disposed between the support portions, the female body having a through hole passing in the second direction through at least a portion in the second direction of the female body;

a female terminal held in the female body; and a shaft received in the support holes of the support portions and the through hole of the female body so as to support the female body floatably along the second direction.

2. A female connector for mating with a male connector, the female connector comprising:

a guide extending in a first direction, the guide being configured to guide the male connector in the first direction such that the male connector is floatable along a second direction, the second direction being orthogonal to the first direction;

a pair of support portions on one side in the first direction relative to the guide, the support portions being spaced from each other in the second direction and each having a support hole passing therethrough in the second direction;

a female body being insulative and disposed between the support portions, the female body having at least one through hole passing in the second direction through at least a portion in the second direction of the female body;

a female terminal held in the female body; and a shaft extending in the second direction through the at least one through hole of the female body, being fixed to the female body, and being received in the support holes of the support portions such as to be floatable along the second direction.

3. A female connector for mating with a male connector, the female connector comprising:

a guide extending in a first direction, the guide being configured to guide the male connector in the first direction such that the male connector is floatable along a second direction, the second direction being orthogonal to the first direction;

a pair of support portions on one side in the first direction relative to the guide, the support portions being spaced from each other in the second direction;

a pair of covers extending from the respective support portions such as to cover the female body from one side in a third direction, the third direction being orthogonal to the first and second directions, a female body being insulative and disposed between the support portions, the female body including at least one opposing portion facing the support portions; and a female terminal held in the female body, wherein the female terminal includes a contact portion exposed to the other side in the third direction out of the female body, the opposing portion includes a shaft part extending in the second direction and the support portions have a support hole receiving the shaft part such that the shaft part is floatable along the second direction, or alternatively the support portions include a shaft part extending in the second direction and the opposing portion has a support hole receiving the shaft part such that the shaft part is floatable along the second direction, the guide includes a pair of rails extending in the first direction and a bottom between the rails, the rails are configured to guide a runner of the male connector in the first direction, with the runner being received between the rails with a clearance in the second direction, and the bottom is located on the other side in the third direction relative to the contact portion of the female terminal.

4. The female connector according to claim 1, wherein
the guide includes a pair of rails extending in the first direction, and
the rails are configured to guide a runner of the male connector in the first direction, with the runner being received between the rails with a clearance in the second direction.

5. The female connector according to claim 2, wherein
the guide includes a pair of rails extending in the first direction, and
the rails are configured to guide a runner of the male connector in the first direction, with the runner being received between the rails with a clearance in the second direction.

6. The female connector according to claim 1, wherein
the guide includes at least one rail extending in the first direction, and
the rail is configured to guide the male connector in the first direction, with the rail being received, with a clearance in the second direction, in a runner groove of a runner of the male connector.

7. The female connector according to claim 2, wherein
the guide includes at least one rail extending in the first direction, and
the rail is configured to guide the male connector in the first direction, with the rail being received, with a clearance in the second direction, in a runner groove of a runner of the male connector.

8. The female connector according to claim 4, further comprising
a pair of covers extending from the respective support portions such as to cover the female body from one side in a third direction, the third direction being orthogonal to the first and second directions, wherein
the female terminal includes a contact portion exposed to the other side in the third direction out of the female body,
the guide further includes a bottom between the rails, and
the bottom is located on the other side in the third direction relative to the contact portion of the female terminal.

9. The female connector according to claim 5, further comprising
a pair of covers extending from the respective support portions such as to cover the female body from one side in a third direction, the third direction being orthogonal to the first and second directions, wherein
the female terminal includes a contact portion exposed to the other side in the third direction out of the female body,
the guide further includes a bottom between the rails, and
the bottom is located on the other side in the third direction relative to the contact portion of the female terminal.

10. The female connector according to claim 1, wherein
the guide includes a pair of first abutment portions, and
the female connector further comprises a female biasing portion, the female biasing portion being provided at the guide such as to bias the male connector to one side in a third direction to bring the male connector into abutment with the first abutment portions, the third direction being orthogonal to the first and second directions.

11. The female connector according to claim 2, wherein
the guide includes a pair of first abutment portions, and
the female connector further comprises a female biasing portion, the female biasing portion being provided at the guide such as to bias the male connector to one side in a third direction to bring the male connector into abutment with the first abutment portions, the third direction being orthogonal to the first and second directions.

12. The female connector according to claim 1, further comprising:
a pair of abutment portions extending from the respective support portions and abutting the female body from one side in a third direction, the third direction being orthogonal to the first and second directions; and
a female biasing portion provided at the guide such as to bias the male connector to the one side in the third direction to bring a male terminal of the male connector into elastic contact with the female terminal.

13. The female connector according to claim 2, further comprising:
a pair of abutment portions extending from the respective support portions and abutting the female body from one side in a third direction, the third direction being orthogonal to the first and second directions; and
a female biasing portion provided at the guide such as to bias the male connector to the one side in the third direction to bring a male terminal of the male connector into elastic contact with the female terminal.

14. The female connector according to claim 8, wherein
the covers extend from the respective support portions and abut the female body from the one side in the third direction, and
the female connector further comprises a female biasing portion provided at the guide such as to bias the male connector to the one side in the third direction to bring a male terminal of the male connector into elastic contact with the female terminal.

15. The female connector according to claim 9, wherein
the covers extend from the respective support portions and abut the female body from the one side in the third direction, and
the female connector further comprises a female biasing portion provided at the guide such as to bias the male connector to the one side in the third direction to bring a male terminal of the male connector into elastic contact with the female terminal.

16. The female connector according to claim 4, wherein
the guide further includes a bottom between the rails, and
the bottom includes an end portion on the one side in the first direction, the end portion having an opening passing through the bottom in a third direction, the third direction being orthogonal to the first and second directions.

17. The female connector according to claim 5, wherein
the guide further includes a bottom between the rails, and
the bottom includes an end portion on the one side in the first direction, the end portion having an opening passing through the bottom in a third direction, the third direction being orthogonal to the first and second directions.

18. The female connector according to claim 6, wherein
the guide further includes a bottom between the rails, and
the bottom includes an end portion on the one side in the first direction, the end portion having an opening passing through the bottom in a third direction, the third direction being orthogonal to the first and second directions.

19. The female connector according to claim 7, wherein the guide further includes a bottom between the rails, and the bottom includes an end portion on the one side in the first direction, the end portion having an opening passing through the bottom in a third direction, the third direction being orthogonal to the first and second directions.

20. A connection structure of a female connector and a male connector, the connection structure comprising:

the female connector according to claim 1; and a male connector, comprising:

a runner configured to be guided in the first direction by the guide of the female connector such that the runner is floatable along the second direction;

a male body; and a male terminal held in the male body, the male terminal being contactable with the female terminal of the female connector.

21. A connection structure of a female connector and a male connector, the connection structure comprising:

the female connector according to claim 2; and a male connector, comprising:

a runner configured to be guided in the first direction by the guide of the female connector such that the runner is floatable along the second direction;

a male body; and a male terminal held in the male body, the male terminal being contactable with the female terminal of the female connector.

22. The connection structure according to claim 20, wherein the guide of the female connector further includes a female engagement portion being an engagement hole extending in the second direction, the male connector further comprises a male engagement portion and a male biasing portion, the male body includes an accommodation portion configured to accommodate the male engagement portion such that the male engagement portion is movable in the second direction, the male biasing portion is configured to exert an biasing force on the male engagement portion to one side in the second direction, the guide of the female connector is configured such that, while guiding the runner of the male connector, the guide presses and moves the male engagement portion to the other side in the second direction against the biasing force of the male biasing portion, and the male engagement portion is configured such that, when the male terminal is brought into contact with the female terminal and the accommodation portion is brought into communication with the female engagement portion, the male engagement portion is moved to the one side in the second direction by the biasing force of the male biasing portion and engages with the female engagement portion.

23. The connection structure according to claim 21, wherein the guide of the female connector further includes a female engagement portion being an engagement hole extending in the second direction, the male connector further comprises a male engagement portion and a male biasing portion, the male body includes an accommodation portion configured to accommodate the male engagement portion such that the male engagement portion is movable in the second direction, the male biasing portion is configured to exert a biasing force on the male engagement portion to one side in the second direction, the guide of the female connector is configured such that, while guiding the runner of the male connector, the guide presses and moves the male engagement portion to the other side in the second direction against the biasing force of the male biasing portion, and the male engagement portion is configured such that, when the male terminal is brought into contact with the female terminal and the accommodation portion is brought into communication with the female engagement portion, the male engagement portion is moved to the one side in the second direction by the biasing force of the male biasing portion and engages with the female engagement portion.

24. The female connector according to claim 3, further comprising:

a pair of abutment portions extending from the respective support portions and abutting the female body from one side in a third direction, the third direction being orthogonal to the first and second directions; and a female biasing portion provided at the guide such as to bias the male connector to the one side in the third direction to bring a male terminal of the male connector into elastic contact with the female terminal.

25. The female connector according to claim 3, wherein the covers extend from the respective support portions and abut the female body from the one side in the third direction, and the female connector further comprises a female biasing portion provided at the guide such as to bias the male connector to the one side in the third direction to bring a male terminal of the male connector into elastic contact with the female terminal.

26. A connection structure of a female connector and a male connector, the connection structure comprising the female connector and the male connector, wherein the female connector comprises:

a guide extending in a first direction, the guide being configured to guide the male connector in the first direction such that the male connector is floatable along a second direction, the second direction being orthogonal to the first direction, the guide including a female engagement portion being an engagement hole extending in the second direction;

a pair of support portions on one side in the first direction relative to the guide, the support portions being spaced from each other in the second direction;

a female body being insulative and disposed between the support portions, the female body including at least one opposing portion facing the support portions; and a female terminal held in the female body, wherein the opposing portion includes a shaft part extending in the second direction and the support portions have a support hole receiving the shaft part such that the shaft part is floatable along the second direction, or alternatively the support portions include a shaft part extending in the second direction and the opposing portion has a support hole receiving the shaft part such that the shaft part is floatable along the second direction, the male connector comprises:

a runner configured to be guided in the first direction by the guide of the female connector such that the runner is floatable along the second direction;

a male body;

a male terminal held in the male body, the male terminal being contactable with the female terminal of the female connector;

a male engagement portion; and a male biasing portion, wherein the male body includes an accommodation portion configured to accommodate the male engagement portion such that the male engagement portion is movable in the second direction, the male biasing portion is configured to exert a biasing force on the male engagement portion to one side in the second direction, the guide of the female connector is configured such that, while guiding the runner of the male connector, the guide presses and moves the male engagement portion to the other side in the second direction against the biasing force of the male biasing portion, and the male engagement portion is configured such that, when the male terminal is brought into contact with the female terminal and the accommodation portion is brought into communication with the female engagement portion, the male engagement portion is moved to the one side in the second direction by the biasing force of the male biasing portion and engages with the female engagement portion.

* * * * *